US012490852B2

(12) United States Patent
Chiappetta

(10) Patent No.: US 12,490,852 B2
(45) Date of Patent: Dec. 9, 2025

(54) COLLAPSIBLE SAFE BOX

(71) Applicant: Anthony Chiappetta, San Diego, CA (US)

(72) Inventor: Anthony Chiappetta, San Diego, CA (US)

( * ) Notice: Subject to any disclaimer, the term of this patent is extended or adjusted under 35 U.S.C. 154(b) by 0 days.

(21) Appl. No.: 18/404,571

(22) Filed: Jan. 4, 2024

(65) Prior Publication Data

US 2024/0130553 A1 Apr. 25, 2024

Related U.S. Application Data

(63) Continuation of application No. 17/302,913, filed on May 14, 2021, now Pat. No. 11,896,150.

(60) Provisional application No. 63/025,718, filed on May 15, 2020.

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01); *A47G 2029/144* (2013.01)

(58) Field of Classification Search
CPC ..... A47G 29/20; A47G 29/141; A47G 2029/144; E05G 1/024; E05G 1/026; E05G 1/005; E05Y 2400/66; B65D 7/26; B65D 9/14; B65D 15/24; B65D 21/086; B65D 11/1853
See application file for complete search history.

(56) References Cited

U.S. PATENT DOCUMENTS

| | | | | |
|---|---|---|---|---|
| 10,143,321 | B2 * | 12/2018 | Hippert | A47G 29/20 |
| 10,299,617 | B1 * | 5/2019 | Castellanos | A47G 29/141 |
| 10,383,471 | B1 | 8/2019 | Barnes | A47G 29/124 |
| 10,512,352 | B1 * | 12/2019 | Torres | A47G 29/22 |
| 10,537,196 | B1 | 1/2020 | MacPherson | A47G 29/141 |
| 10,696,453 | B2 | 6/2020 | Sena | A47G 29/141 |
| 10,743,694 | B2 | 8/2020 | Raphael | A47G 29/141 |
| 10,743,695 | B1 | 8/2020 | Altmaier | B60R 9/065 |
| 10,758,071 | B1 | 9/2020 | Lin et al. | |
| 10,772,451 | B2 * | 9/2020 | Vernal Silva | A47G 29/20 |
| 10,786,103 | B2 | 9/2020 | Teoh | B65D 11/1853 |
| 11,033,137 | B2 | 6/2021 | Geng | A47G 29/16 |
| 11,087,269 | B2 * | 8/2021 | Newcomb | A47G 29/141 |
| 11,510,517 | B2 | 11/2022 | McLean | B65D 11/1853 |

(Continued)

FOREIGN PATENT DOCUMENTS

| | | | |
|---|---|---|---|
| CN | 202544628 | U | 11/2012 |
| CN | 103291172 | A | 9/2013 |

(Continued)

OTHER PUBLICATIONS

PCT Search Report & Written Opinion dtd Aug. 3, 2021, 6 pages.

*Primary Examiner* — William L Miller
(74) *Attorney, Agent, or Firm* — Dentons US LLP; Derek A Auito

(57) ABSTRACT

A collapsible safe box that can be removably or permanently affixed to a structure. The collapsible safe box may include protractible and retractable side member, bottom member, and lid. The collapsible safe box may include one or more electronic devices to monitor and operate the functioning of the safe box. In examples, the collapsible safe box may include means to allow for remove operation.

20 Claims, 20 Drawing Sheets

(56) References Cited

U.S. PATENT DOCUMENTS

| | | | | |
|---|---|---|---|---|
| 11,617,465 | B2 | 4/2023 | Zhang | A47G 29/141 232/38 |
| 11,666,169 | B1 | 6/2023 | Altmaier | A47G 29/20 232/33 |
| 11,751,708 | B2 * | 9/2023 | Wu | A47G 29/141 232/19 |
| 12,004,672 | B2 * | 6/2024 | Evangelidis | A47G 29/141 |
| 12,016,478 | B2 * | 6/2024 | Newcomb | E05B 47/0001 |
| 12,022,969 | B1 * | 7/2024 | Waltereze | A47G 29/141 |
| 12,029,339 | B2 * | 7/2024 | Abderrazak | A47G 29/22 |
| 12,157,603 | B2 * | 12/2024 | Aliahmad | A47G 29/141 |
| 12,178,344 | B2 * | 12/2024 | Redford | B65D 43/168 |
| 12,262,832 | B1 * | 4/2025 | Lipps, Jr. | A47G 29/16 |
| 2016/0051073 | A1 * | 2/2016 | Heinz | A47G 29/141 232/39 |
| 2016/0068306 | A1 * | 3/2016 | Heinz | B65D 85/70 220/6 |
| 2017/0091710 | A1 * | 3/2017 | Van Dyke | B64U 10/13 |
| 2017/0127868 | A1 * | 5/2017 | Adewuyi | A47G 29/22 |
| 2018/0029760 | A1 * | 2/2018 | Maser | B65D 43/16 |
| 2018/0125278 | A1 | 5/2018 | Jiang | |
| 2018/0228310 | A1 | 8/2018 | Enobakhare et al. | |
| 2018/0296016 | A1 | 10/2018 | Teoh | A47G 29/20 |
| 2019/0167025 | A1 | 6/2019 | Cherry | A47G 29/16 |
| 2019/0180544 | A1 * | 6/2019 | Newcomb | E06B 7/32 |
| 2019/0225375 | A1 | 7/2019 | Sena | |
| 2019/0320836 | A1 | 10/2019 | Guanch | A47G 29/20 |
| 2019/0350398 | A1 | 11/2019 | Raphael et al. | |
| 2019/0362577 | A1 * | 11/2019 | Vigil | G07C 9/27 |
| 2021/0005033 | A1 * | 1/2021 | Roman | G06Q 10/0833 |
| 2021/0127880 | A1 | 5/2021 | Raphael | A47G 29/141 |
| 2021/0361104 | A1 * | 11/2021 | McLean | B65D 15/24 |
| 2022/0257041 | A1 | 8/2022 | Redford | B65D 11/186 |
| 2022/0267048 | A1 | 8/2022 | Rogers | A47G 29/141 |

FOREIGN PATENT DOCUMENTS

| | | | | |
|---|---|---|---|---|
| CN | 203420569 | U | 2/2014 | |
| WO | 2019217232 | U | 11/2019 | |
| WO | WO-2025034248 | A1 * | 2/2025 | A47G 29/141 |

* cited by examiner

COLLAPSIBLE SAFE BOX

CROSS REFERENCE TO RELATED APPLICATION

The present application is a continuation of U.S. patent application Ser. No. 17/302,913, filed on May 14, 2021, now allowed, which claims priority from U.S. provisional application no. 63/025,718, filed on May 15, 2020, the entire contents of all of which are hereby incorporated by reference.

FIELD OF THE INVENTION

The present invention relates to a collapsible safe box.

BACKGROUND OF THE INVENTION

Package delivery to residential and business premises is a ubiquitous practice. While carriers and delivery agencies can take the appropriate precautions that a package is safely transported to its destination, the safety of the package becomes compromised once it is left unattended at the receiving party's premises or business. Left unattended, the package can often be the target of theft or destruction.

To address this problem a series of delivery receptacles have been devised that can safely secure the package between the time it is delivered and the time the recipient is able to take physical possession of the package. Exemplary systems to safely keep delivered packages are described in U.S. Pat. No. 10,143,321, US Patent Publication Nos. 20160051073, 20170091710, 20170127868, 20180029760, International Publication No. WO2019217232, and Chinese Patent Publications No. CN103291172, CN202544628, and CN203420569. All these documents are incorporated herein by reference in their entirety.

While the above identified publications may provide for secured receptacles for a variety of different objects, they often require either a permanent bulky secured structure and/or permanent installation on the grounds or wall of the premises or business. For these reasons, the disclosed devices are not conducive for situations where a permanent structure is either not allowed or where a permanent bulky structure is inconvenient. For example, in an apartment or condo complex, a tenant or owner might not be able to add permanent secured fixture to its front door or wall to receive packages. Also, having secured package delivery boxes by each door of an apartment or condo complex could be a nuisance.

Accordingly, there is a need for a delivery structure that can be easily removably installed and/or collapsible to yet provide a safe receptacle for deliveries that does not involve a bulky structure to always be present.

SUMMARY OF THE INVENTION

Examples of collapsible safe box can substantially obviates one or more of the problems due to limitations and disadvantages of the related art.

Examples can provide a collapsible safe box that can be securely yet removably installed.

Examples can provide a collapsible safe box that can be expanded and securely accessed to store a package.

Examples can provide a collapsible smart safe box wherein the safe box is equipped with one or more computing related elements. For example, a smart safe box could be one that includes any one or more of a smart locks, one or more sensors, one or more cameras, one or more scanners, one or more transceivers, one or more solar panels, one or more sterilizers, one or more alarms, one or more global positioning systems (GPS), a controller alone or with any one or more components that works together with the controller as described herein, or any combination thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a collapsible safe box including a back panel; a front panel; a protractible and retractable side member; a protractible and retractable lid; a protractible and retractable bottom member; a frame connected to the back panel, the frame configured to removably and securely engage a structure.

The collapsible safe box can further include a battery. In examples, the protractible and retractable side member may include alternating rows of panels and sheets. In examples, the protractible and retractable bottom member may include alternating rows of panels and sheets. In examples, the side member and the bottom member may include alternating rows of panels and sheets.

In examples, the safe box can include at least two protractible and retractable side members. Each protractible and retractable side member can include a foldable panel system and further include an extendable shaft that connects the at least two foldable panel systems. The extendable shaft can be connected to the at least two foldable panel systems at areas in which each side panel pivots. The extendable shaft can include a lock that keeps the shaft maintain an extended state. For example, the shaft can be a touch button release by spring/piston action to its open position.

In examples, the safe box may include a telescoping arm operably connected to at least one of the at least two protractible and retractable side members. In examples, the safe box may include a track along which at least one of the at least two protractible and retractable side members travel when protracting or retracting.

The protractible and retractable bottom member can include a flexible material. The protractible and retractable bottom member can include a material selected from the group of rubber, polymer, and combination thereof. In examples, the safe box may include a roller configured to wind and unwind the protractible and retractable bottom member. In examples, the safe box may include a telescoping arm operably connected to the protractible and retractable bottom member.

In examples, the frame can include an expandable structure configured to securely clamp onto a support. The support can be a door, gate, hatch, or portal.

In examples, the back panel, front panel, protractible and retractable side member, and protractible and retractable bottom member can be made of the same of different material, each selected from the group consisting of: powder coated steel, hemp steel flex, aluminium, galvanized, fiberglass, and graphite carbon.

The front panel further can include a cover on an outside surface. The cover may include a decorative cover. The decorative cover can include art deco. The front panel can mimic the existing door design. In examples, the cover may include a display screen.

The protractible and retractable lid further can include a smart lock. The smart lock can be configured to engage with the front panel, one or more protractible and retractable side members, or a combination thereof.

The collapsible safe box can include a camera. The camera can be arranged to capture the environment outside the collapsible safe box. The camera can be arranged to capture the environment inside the collapsible safe box.

The collapsible safe box can include one or more sensors. The one or more sensors can be arranged to detect whether the safe box is secured. The one or more sensors can be arranged to detect whether the contents of the safe box are secured.

The collapsible safe box can include an alarm.

The collapsible safe box can include a sterilizer. The sterilizer can be located inside the safety box. The sterilizer can be a UV light emitter.

The collapsible safe box can include one or more hinges. The one or more hinges can be configured to connect the protractible and retractable lid to the back panel. A first hinge can be configured the protractible and retractable side member to the back panel, and a second hinge can connect the protractible and retractable side member to the front panel.

The collapsible safe box can include a scanner. For example, a QR scanner.

In examples, the protractible and retractable lid may include an articulated lid. The articulated lid may include two or more pivotally joined panels, sections, or slabs. In examples, the protractible and retractable lid when engaged to the front panel it is configured to have a portion that overlaps at least a front surface of the front panel or that remains horizontal to a bottom portion of the safe box, or both.

In another aspect of the present invention, a collapsible safe box that includes a back panel; a front panel; a protractible and retractable side member; a protractible and retractable lid; a protractible and retractable bottom member; a smart lock; a frame permanently securing to the safe box to a structure. The structure is a wall. The back panel can include an access door. The access door can include a smart lock.

In another aspect of the present invention, a method of securing an item including expanding a collapsible safe box as described in any of the preceding paragraphs, placing the item inside the expanded safe box, and locking the safe box. In examples, the method including accessing the item inside the expanded safe box, and collapsing the safe box into a stowed position.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate examples of the invention and together with the description serve to explain the principles of the invention.

In the drawings.

DETAILED DESCRIPTION OF THE ILLUSTRATED EXAMPLES

Figure 1:
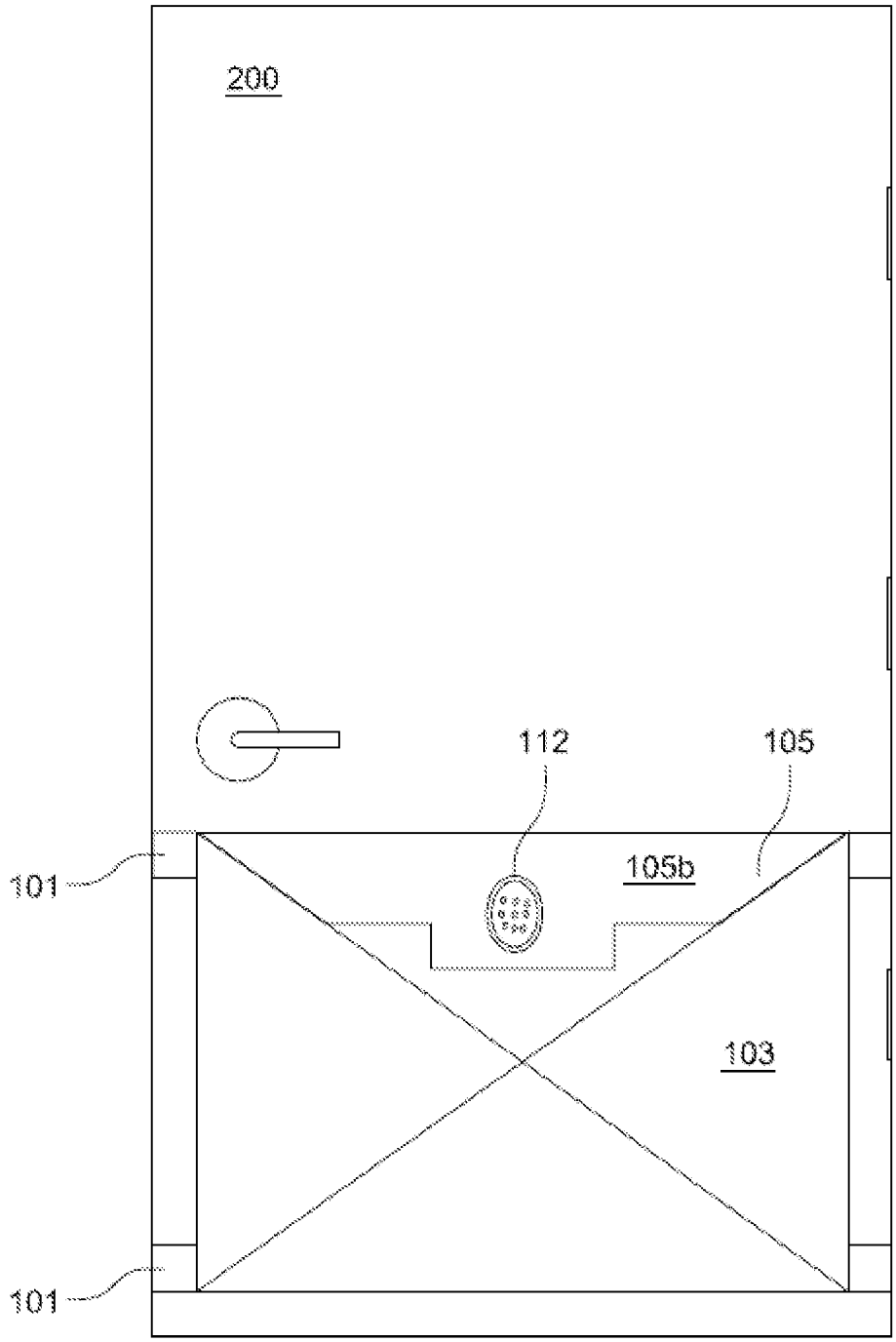
FIG. 1 illustrates an example of a safe box installed on a door while in a collapsed state.

Reference will now be made in detail to an example of the present invention, example of which is illustrated in the accompanying drawings.

Unless defined otherwise, all technical and scientific terms used herein have the same meaning as is commonly understood by one of skill in the art to which the inventions belong. All patents, patent applications, published applications and publications, websites and other published materials referred to throughout the entire disclosure herein, unless noted otherwise, are incorporated by reference in their entirety. In the event that there are a plurality of definitions for terms herein, those in this section prevail. Where reference is made to a URL or other such identifier or address, it is understood that such identifiers can change and particular information on the internet can come and go, but equivalent information can be found by searching the internet. Reference thereto evidences the availability and public dissemination of such information.

As used herein, the singular forms "a," "an" and "the" include plural referents unless the context clearly dictates otherwise.

As used herein, the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example examples.

As used herein, ranges and quantities can be expressed as "about" a particular value or range. "About" also includes the exact amount. Hence "about 5 percent" means "about 5 percent" and also "5 percent." "About" means within typical experimental error for the application or purpose intended.

As used herein, "optional" or "optionally" means that the subsequently described event or circumstance does or does not occur, and that the description includes instances where the event or circumstance occurs and instances where it does not. For example, an optional component in a system means that the component may be present or may not be present in the system.

As used herein, a "combination" refers to any association between two items or among more than two items. The association can be spatial or refer to the use of the two or more items for a common purpose.

As used herein, "comprising" and "including" are meant to be inclusive of other elements or parts unless otherwise specifically described. Thus, for example, if an element or feature is described as being included or comprised, it does not mean that other elements or features are excluded, but that other elements or features can also be further be present.

In examples, an expandable and collapsible safe box may be provided for securing items such as parcels/packages from theft and potential damage from the elements when delivered to homes/businesses. The safe box can be adhered to and removed for reuse (without drilling any holes or using screws) on any fixture or other support structure. The safe box can be provided at different locations and its applications can be for any purpose involving the temporary or permanent storage of an item. In examples, the safe box can be affixed to any suitable support including but not limited to, steel structures, doors, gates, wood structures, security structures, brick structures, or any other structural fixture, building, or part of a building or fixture.

In examples, the safe box may be used to receive of return an item, package, or parcel. In examples, a deliverer may place an item, package, or parcel in the safe box upon delivery. In examples, a user may place an item, package, or parcel. in the safe box for pickup by a delivery person. In examples, one or more parcels or packages may be placed in the safe box for safe keeping upon delivery or in anticipation of pickup by a delivery service. In examples, upon closing the safe box lid or access panel door a lock can be engaged to secure the contents inside the safe box. In examples, the safe box can include one or more sensors able to activate one or more hidden cameras to record and confirm the one or more parcels or packages were safely placed in the safe box.

A software application can be used to notify the recipient (for example, live time) the receipt of the one or more parcels or packages.

During and until recipient retrieves said one or more parcels or packages from the safe box, the items, parcels or packages can remain securely locked avoiding any convenient theft. In this manner the safe box may deter any attempts to steal the delivered items. In examples, the safe box may be equipped with an alarm that may set off if there is an attempt to temper with the safe box.

In examples, the safe box can be locked using a traditional lock, a smart lock or any combination thereof. Any suitable locking mechanism may be employed to achieve a secure engagement of a lid with a front panel, one or more side members, or any combination thereof. In examples, the locking mechanism may include clamps, hooks, screws, hole and pin systems, male-female fittings configured to engage when coupled, gears, magnets, electromagnets, or any combination thereof. Although discussed in the singular form for easy of discussion, in examples, two or more locking mechanisms may be employed. In examples, the lock may include a touch screen or keypad. The lock can include a night light. The safe box can include one or more hidden cameras and sensors. The safe box can optionally include a GPS tracker.

Retrieval of the delivered parcels or packages from the safe box may be effectuated by performing one and or more access functions. In examples, the steps required to retrieve the contents from a safe box may be set according to the preferences of a user. In examples, access to the inside of a locked safe box may include one or more of a security code, symbol scanner such as QR code, bar code, or similar symbology, finger scan, iris scan, voice recognition, physical or electronic key, any combination thereof, or any other like manner. In examples, access to the safe box may require a 4 to 5 digit code on a touch screen or key pad. For example, a scanner may be provided to allow for scanning a fingerprint, iris, symbology or other scannable item. Other means to unlock the safe box and access the package can also be available as described in more detail below.

In examples, as also described in more detail below, the safe box may be equipped with one or more sensors that are able to detect when an item such as a parcel or package is placed inside the safe box. In examples, in response to detecting an item placed in the safe box, one or more UV lights can be activated. For example, one or more sensors can be triggered by the item or package touching a portion of the bottom of the safe box. In examples, the sensor can be an optical sensor and be triggered by visual appearance of the item or package. Other alternatives are also available. In examples, one or more sensor can send a signal to a controller, a UV light controller, a switch, or any combination thereof. In examples, one or more UV light emitters can be triggered by a signal from the one or more sensors, from a controller, from a switch, or any combination thereof. In examples, one or more UV light emitters can be set on a self-timer within the safe box. The UV light emitter can be configured to irradiate the contents of a safe box. In examples, UV light can be used for disinfecting the items or deposited parcels or packages placed inside the safe box.

In examples, a collapsible safe box that can be securely and yet removably installed onto a support. FIG. 1 illustrates an example of a safe box 100 that may be installed on any support 200 that can be secured by a frame of the collapsible safe box 100. In examples, such as shown in FIG. 1, the support 200 to which the safe box 100 can be removably installed is a door. For example, the safe box 100 can be affixed to the door panel. In examples, the support can be any fixture or structure that is able to support the safe box as described herein. In examples, the support is a gate, a door, a hatch, a portal, a wall, a window, a fixture, a building, a free stranding structure, any combination thereof, or any parts thereof. For the purposes of this description, the safe box 100 will be described as removably installed on a door panel. This is simply and example and the same or similar features described can be applied to any other support.

As illustrated in FIGS. 1 and 2A-2E, a safe box 100 can include a frame 101, a back panel 102, a front panel or facia 103, at least one side member 104, a lid 105, and a bottom member 106. In examples, the at least one side member 104 is a protractible and retractable side member 104. In examples, lid 105 is a protractible and retractable lid 105. In examples, the bottom member 106 is a protractible and retractable bottom member 106. In examples, the collapsible safe box 100 includes two side members 104. In examples, the two side members 104 are two protractible and retractable side members 104.

For purposes of this disclosure, the terms "protract" and "protractible" are used to indicate an ability to extend forward or outward, increase in length, and/or extend from a first location to a second location. In examples, any extension means can be employed. In examples, extension may include unfolding, lengthening, flattening, stretching, decompressing, opening, spreading, pulling, sliding out, unrolling, unwinding, moving from a stored position to an unstored position, or any like movement and any combination thereof.

For purposes of this disclosure, the terms "retract" and "retractable" are used to indicate an ability to withdraw, draw back, shorten in length, and/or to recede or retreat from a second location to a first location. For purposes of this description, retract is used as opposite to protract. In examples, any shortening, withdrawing, or receding means can be employed. In examples, the shortening, withdrawal, or recession can include folding, overlapping, compressing, closing, condensing, constricting, condensing, form into a bunch, sliding in, rolling, winding, moving from an unstored position to a stored position, or any like movement and combination thereof. Additional examples by which protraction and retraction can be achieved for each component of safe box 100 is described herein.

For purposes of this disclosure, reference to any protractible and/or retractable structure, including any side member, bottom member, and lid, may be referred to as fully or partially "deployed" or in a full or partial "deployed state" when fully or partially protracted, and as fully or partially "stowed" or in a full or partial "stowed state" when fully or partially retraced. In examples, any protractible and/or retractable structure can be fully or partially deployed, fully or partially stowed, or any combination thereof.

Each of the front and back panels, side members, bottom member, and lid described herein can be independently selected to be any desired shape that allows for the functioning of the safe box 100. In examples, the front and back panels, side members, bottom member, and lid have the same or different shapes. In examples, the front and back panels, side members, bottom member, and lid have quadrilateral shapes. Other shapes can also be used such as circular, triangular, irregular, or any combination thereof. For the side members, bottom member, or lid that protract and retract, it should be understood that their shape as described is at least in the fully protracted state.

Any protractible and retractable structure as described herein and any panel, section, or slab of any such structure may also have any desired shape. In examples, each protractible and retractable structure as described herein and any panel, section, or slab of any such structure may independently have a shape that is quadrilateral, circular, triangular, irregular, or any combination thereof.

In examples, the front panel or facia 103 and back panel 102 can be arranged to be generally parallel to each other. The side members 104, if two are present, can be arranged to be generally parallel to each other at least when in the protracted or partially protracted state. In examples, the bottom member 106 and the lid 105 can be arranged to be generally parallel to each other at least when in the protracted or partially protracted state. In examples, the bottom member 106 and the lid 105 can be arranged to include at least a respective portion thereof that is generally parallel to each other when in the stowed state.

In examples, a protractible and/or retractable panel, member, or lid refers to a structure that can be extended and/or collapsed by any means. In examples, a protractible and/or retractable panel, member, or lid, can be a foldable panel system, a flexible sheet, a foldable lid, a combination of one or more panels and one or more flexible sheets, a combination of one or more foldable panel systems and one or more flexible sheets, or any combination thereof. In examples, protraction and/or retraction may be accomplished by way of sliding a structure. Sliding of a structure can be accomplished by any suitable means, such as for example, using a rails system, a slide, a channel and wheels, or any like structure and any combination thereof. In examples, protraction and/or retraction may be a combination of sliding and folding and/or unfolding.

Any suitable material that can provide a resilient structure can be used for the panels of the front and back panels and for any foldable panel system, or other panel that is used in the collapsible safe box either by itself of in combination with one or more sheets or other material. Exemplary materials for panels include powder coated steel, hemp steel flex, aluminium, galvanized, fiberglass, graphite carbon, and any combination thereof. The various panels can be all made of the same material. Alternatively, the material of each panel can be independently selected. In examples, a panel may be composed of one or more plates joined together. In examples, the plates making up a panel may be made of the same or different material from each other. In examples, the plates may include one or more of the above listed materials for the panels.

For purposes of this disclosure, the term "foldable panel system" refers to a structure that includes two or more pivotally connected panels, sections or slabs. In examples, foldable panel systems can be configured as a structured able to be collapsed, for example, by being folded upon itself. In examples, foldable panel systems can allow for pivoting and/or folding of one panel, section, or slab relative to one or more other panels, sections, or slabs of the foldable panel system. The connections can be made by any means that allow for the rotation of the two connected panels, sections, or slab about an axis. In examples as described herein, the panels, sections, or slabs may be connected by one or more hinges. In examples, hinges can be configured to extend along at least a portion of a panel, section, or slab. In examples, hinges can be configured to be located at a corner, edge, portion, or combination thereof of a panel, section, or slab. In examples, hinges can be configured to have a U-shape and be located only at end portions of a panel, section, or slab. Elements other than hinges can also be used. In place of hinges as discussed throughout this specification, the invention can be implemented by fabric connections, or other joints. According to this definition, a foldable panel system can also be referred to as a collapsible panel structure. As used herein, section in reference to a foldable panel system refers to one or more portions of the foldable panel system and may include one or more panels or slabs. As used herein, "slab" in reference to a foldable panel system refers to a contiguous body of material. In examples, a slab can be the same as a panel. In examples, a slab may be made of the same material as described for a panel.

The terms "sheet" or "flexible sheet" as used herein refer to a canvas or like sheet, or other body of flexible material that can fold or wrinkle when pushed together and can unfold or flatten when pulled or extended without breaking. Any sheet described herein can be made of a flexible material. Flexible materials can include rubber, cut resistant fabric or canvas, polymeric material as exemplified herein, or a combination thereof. The polymeric material can be poly-paraphenylene terephthalamide, also known as Kevlar®. The polymeric material can also be other materials that are likewise resistant to tempering. For example, the polymeric material can be a fluoropolymer, for example polytetrafluoroethylene (PTFE), also known as Teflon®.

In examples, the lid of a safe box as described can be an articulated lid. An articulated lid can include a foldable panel system as defined above but used as the lid of the safe box. In examples, the lid can include a foldable panel system with two or more panels, sections, or slabs pivotally joined. In examples, the lid can include a foldable panel system with at least three panels, sections, or slabs. In examples, the lid can include a foldable panel system with at least four panels, sections, or slabs. Each panel, section, or slab of the foldable panel system included in the lid can have the same or different size as one or more of the other panels, sections, or slabs. In examples, a lid can include either a foldable panel system, a flexible sheet, a combination of panels and sheets, a combination of foldable panel systems and sheets, or any combination thereof as described herein for the side member and/or bottom member. A lid can be configured to allow for full extension of the lid, partial extension of the lid, full retraction of the lid, partial retraction of the lid, or any combination thereof. In examples, a lid may be configured to allow folding of the lid to close the safe box when the safe box partially collapsed. In examples, a lid may be configured to close the safe box when the safe box is fully extended. In examples, the lid may be configured to close the safe box at varying degrees of extension as exemplified in more detail below.

Each of the one or more side members 104 can include either a foldable panel system, a flexible sheet, a combination of panels and sheets, a combination of foldable panel systems and sheets, or any combination thereof. Each side member 104 can be the same or different from any other side member 104. In examples, at least one side member can be a foldable panel system. In examples, each side member can include a foldable panel system. In examples, at least one side member of the safe box 100 can include a rubber or rubber like material sheet. In examples, at least one side member can include a sheet of cut resistant fabric or canvas. In examples, at least one side member can include of a sheet of polymeric material. In examples, at least one side member can include a sheet of flexible material. In examples, at least one side member can include a combination of panels and sheets. In examples, at least one side member can include a structure having alternating panels and sheets. In examples, each side member can include a structure having alternating panels and sheets. In examples, at least one side member is configured to protract and/or retract via an accordion fold. In examples, each side member is configured as an accordion fold type structure. In examples, each side member includes a structure of alternating panels and sheets configured to protract and retract in an accordion manner. In examples, at least one side member can be configured to protract and/or retract as a curtain. In examples, a roller system, a track system, rail system, channel system, wheel system, slide system, or any other suitable mechanism may be used to allow for protraction and/or retraction of at least a side member.

In examples, the bottom member 106 can include either a foldable panel system, a flexible sheet, a combination of panels and sheets, a combination of foldable panel systems and sheets, or any combination thereof. In examples, the bottom member can be a foldable panel system. In examples, the bottom member can include a foldable panel system. In examples, the bottom member of the safe box 100 can include a rubber or rubber like material sheet. In examples, the bottom member can include a sheet of cut resistant fabric or canvas. In examples, the bottom member can include of a sheet of polymeric material. In examples, the bottom member can include a sheet of flexible material. In examples, the bottom member can include a combination of panels and sheets. In examples, the bottom member can include a structure having alternating panels and sheets. In examples, the bottom member can include a structure having alternating panels and sheets. In examples, the bottom member is configured to protract and retract via an accordion fold. In examples, the bottom member is configured as an accordion fold type structure. In examples, the bottom member includes a structure of alternating panels and sheets configured to protract and retract in an accordion manner. In examples, the bottom member can be configured to protract and/or retract as a curtain. In examples, a roller system, a track system, rail system, channel system, wheel system, slide system, or any other suitable mechanism may be used to allow for protraction and/or retraction of the bottom member.

In some examples, each side member and/or bottom member can be made of a sheet.

Figure 6A:
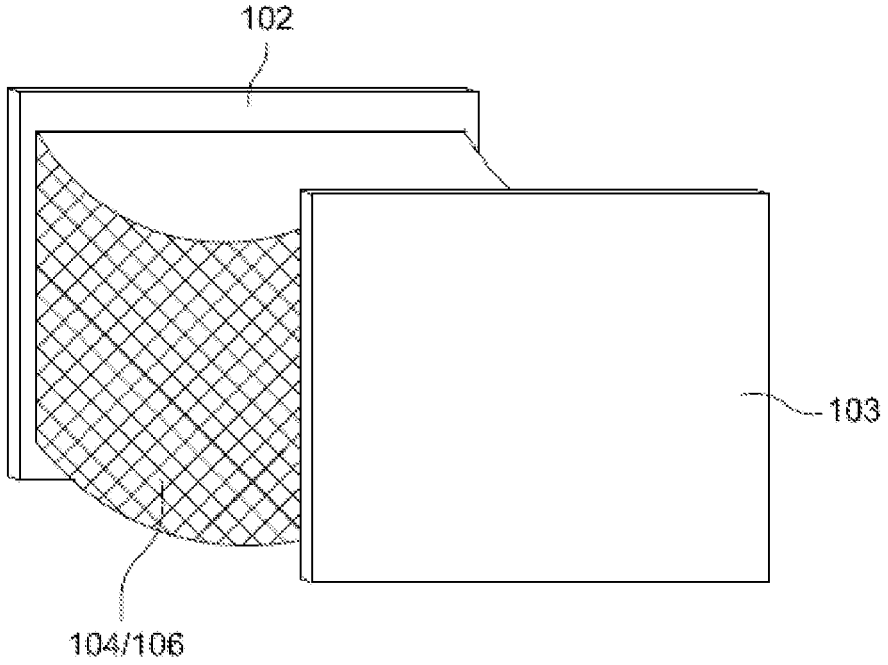
FIGS. 6A and 6B illustrate an example where the side member and bottom member are a contiguous flexible sheet.
Figure 6B:
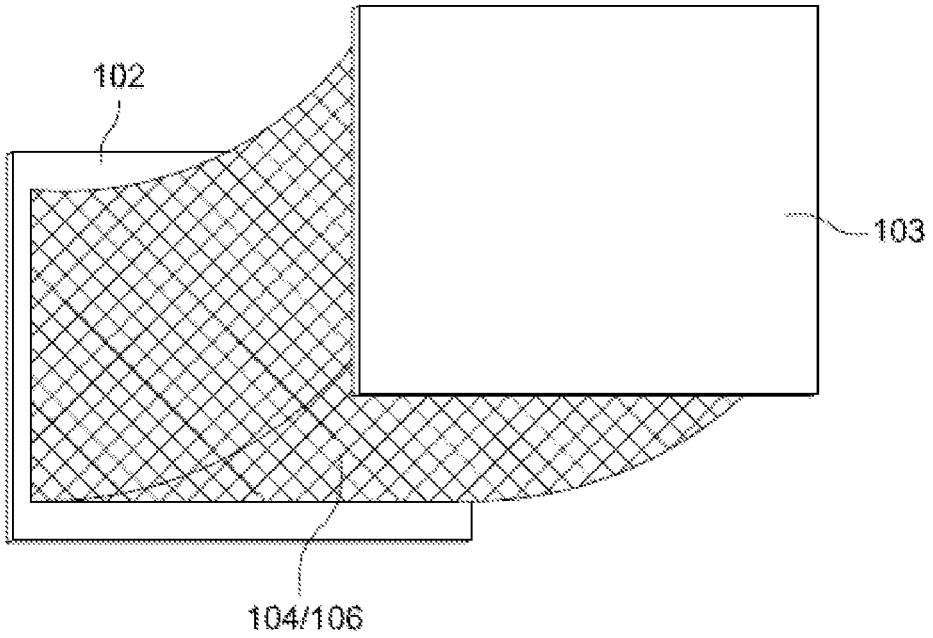

In some examples, as for example illustrated in FIGS. 6A and 6B, the bottom member 106 and side member 104 are formed of a contiguous sheet of cut resistant fabric or canvas structure made of any of the above-mentioned flexible materials.

Referring to FIGS. 2A-2E, examples of a safe box 100 may include a back panel 102 connected to and/or including a frame 101 to secure the safe box 100 to a support 200. The frame 101 can be attached to the back panel by any means that result in a strong, resilient bod. The frame 101 can be welded to the back panel 102. The frame 101 can be secured to the back panel 102 by one or more fasteners such as screws, bolts, or like structure. The frame 101 can be secured to the back panel 102 by an adhesive. The frame 101 can be secured to the back panel 102 by the combination of any one or more of welding, fastener, and adhesive. The frame 101 can be located at one end of the back panel 102. For example, the frame 101 can be connected along an upper portion of the back panel 102 when the safe box 100 viewed in an installed setting. The frame 101 can also be located at both opposite ends, i.e. upper and lower portion or left and right sides of the back panel 102 when the safe box 100 is viewed in an installed position. In examples, the frame 101 can be installed so as to be present along all sides of the back panel 102. In examples, frame 101 and back panel 102 may be an integral structure.

The frame 101 can be made of the same material as the panels. The frame can be also be made of any resilient, rigid material. For example, the frame can be made of a polymer, metal, metal alloy, or a combination thereof. In examples, the frame is made of steel.

The frame 101 can include an adjustable member 130 that can be secured to wrap or clamp to a support 200. Adjustable member 130 may be a bracket, a cable, a clamp, a loop, a belt, any like structure, or any combination thereof that may be used to secure safe box 100 to a support 200. In an example, the frame 101 can be made secured to a support without requiring any modification, drilling, or alternations to the support 200. For example, in an example the frame 101 can include an adjustable member 130 such as an adjustable bracket having a U-shaped fitting design to clamp onto a support 200. In an example, the support 200 is a door. In examples, the bracket 130 can engage a door panel as the support. The length of the frame 101 can be adjusted to accommodate the width or height of the support 200 to which it is to be connected. For example, the length of the bracket 130 can be adjusted to accommodate the width or height of the door panel so that the edges of the door panel fit securely into the U-shaped ends of bracket 130 of the frame 101. The frame 101 can include a mechanical lock such as a rack and pinion gear, an adjustable cable, or any like mechanism to fix the length of the adjustable member 130 in place once installed. An example illustrating a mechanical lock 126 is provided n FIG. 7E. In examples, a cable is employed to wrap around support 200. The adjustable member 130 can also include a coating of a protective material such as rubber or polymer material to prevent scratching of the support.

Figure 3:
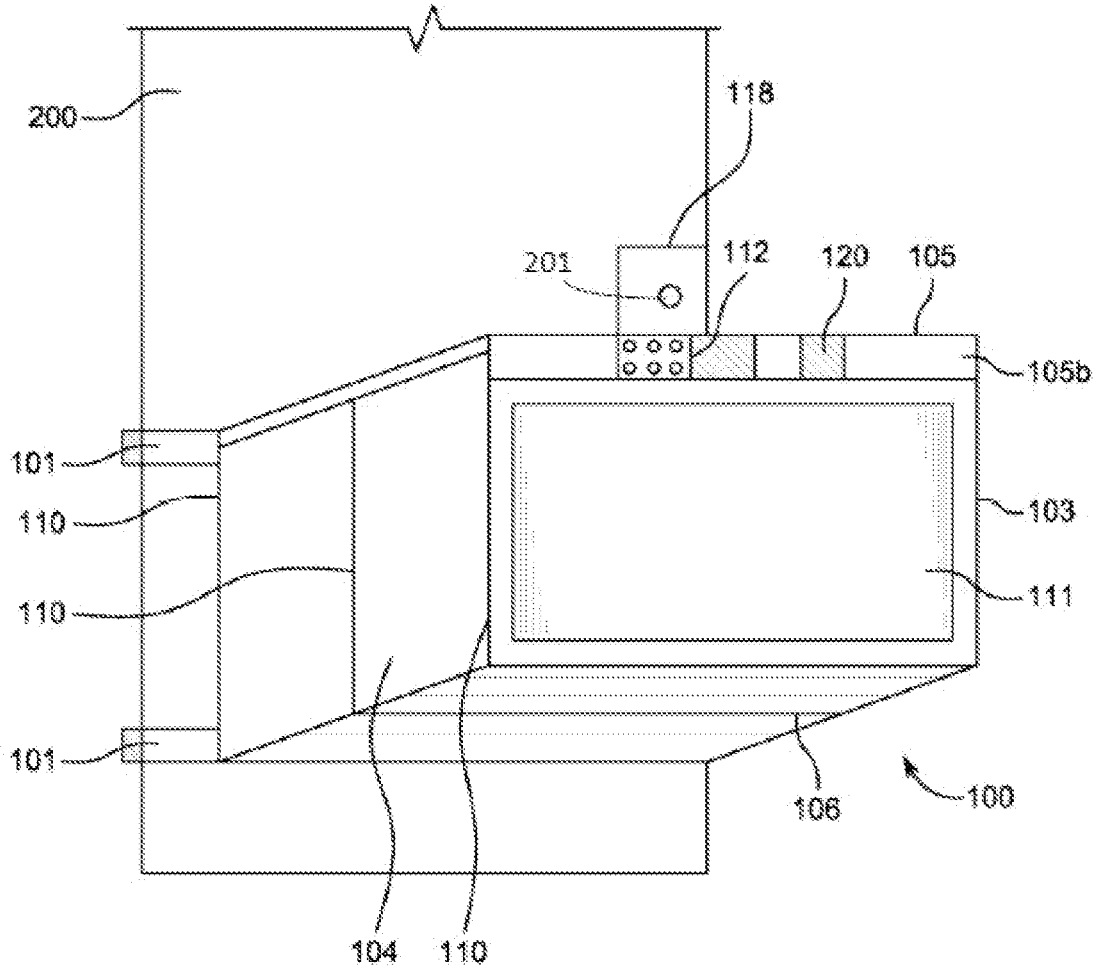
FIG. 3 illustrates the bottom perspective view of examples of a safe box fully extended.

In some examples, the safe box 100 can be installed over the bottom portion of a door panel as for example illustrated in FIGS. 1, 3, and 4. The safe box 100 can also be secured to the fixture through other existing structures. For example, as also illustrated in FIGS. 3 and 4, the frame 101 can extend to a portion of the door panel where the door handle is located where it can be secured by the door handle 201. In an example, the door handle can be installed on the door panel including a lip portion 118 of the frame of the safe box 100. The lip portion 118 of the frame can be configured to include an opening to for the door handle mechanisms to fit through so as not to interfere with the operation of the handle, but still become secured by the door handle. The frame 101 and/or adjustable member 130 may include additional similar extensions or lip portions as lip portion 118 that extend to other features of the support 200 for securing the safe box. For example, when support 200 is a door, the additional lip portions can also extend to and be secured at the door lower or mid hinges. This would be accomplished in a similar manner as described for item 118, except that the lip may be configured to be secured at one or more door hinges rather than the door handle. In examples, adjustable member or bracket 130 may also engage a support such as a door above just above a door hinge 202 or like feature as for examples illustrated in FIG. 7B discussed later. Providing for this arrangement may help prevent sliding of safe box in the vertical direction with respect to support 200.

As illustrated in FIGS. 2A-2E, one or more fasteners 107 can be provided on the back panel 102 or frame 101. These fasteners 107 can be configured to engage reciprocal fasteners 107 on the front panel 103. These cooperative fasteners 107 can be used to hold the collapsible safe box 100 in its collapsed state while not in use. The fasteners 107 can include any means sufficiently strong to keep the front and back panels 102 and 103 together. Exemplary fasters 107 include hooks, male-female fittings, magnets, clamps, push button release lock, mechanism, or hooks, and like structures, or any combination thereof. The number of fasteners 107 is not limited. In an example, the safe box 100 includes at least one fastener 107. The safe box 100 can include two fasteners. In an example, the safe box 100 includes four fasteners 107. The location of the fasteners 107 is not particularly limited. In an example, the one or more fasteners 107 are located on the back panel 102 and front panel 103 at the respective upper portions, lower portions, side portions, or any combination thereof. The fasteners 107 can be made of any resilient material suitable for their function. For example, any material described herein for the frame 101 can also be used for the fasteners 107. Fasteners 107 can also be made of magnetic materials.

Figure 7A:
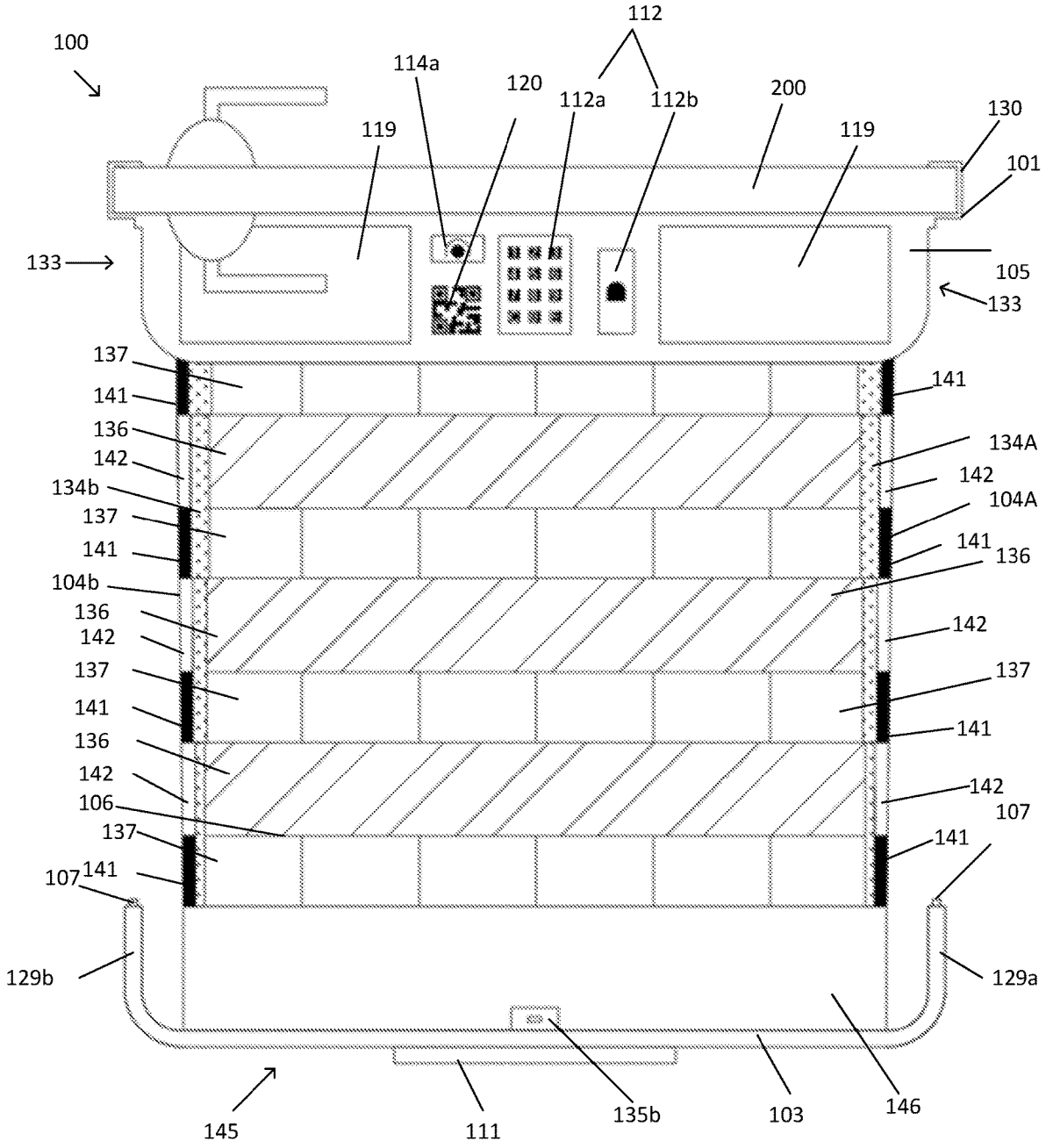
FIGS. 7A-7I illustrate different views of examples of a safe box and components thereof as described herein.
Figure 7B:
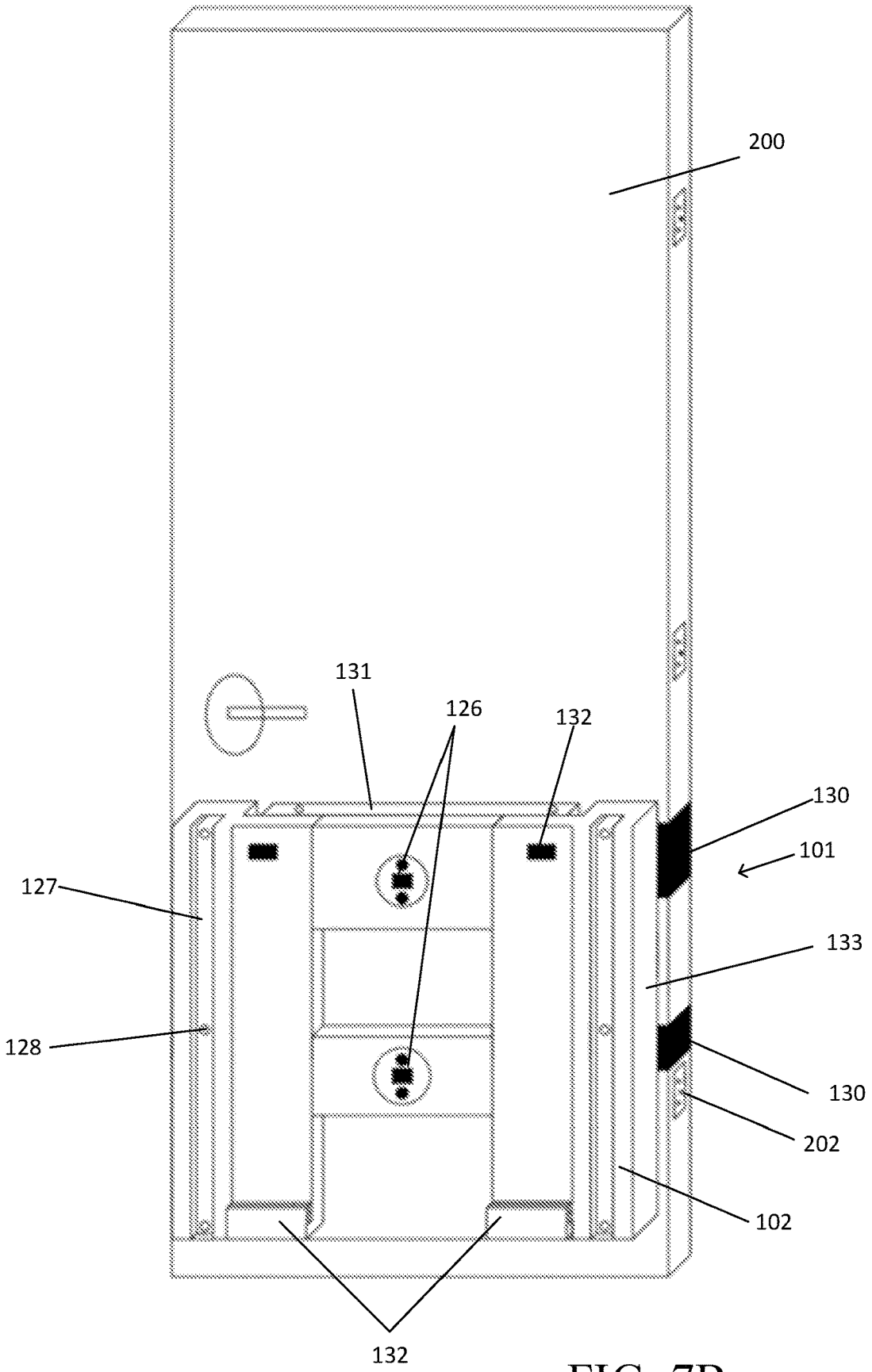
Figure 7C:
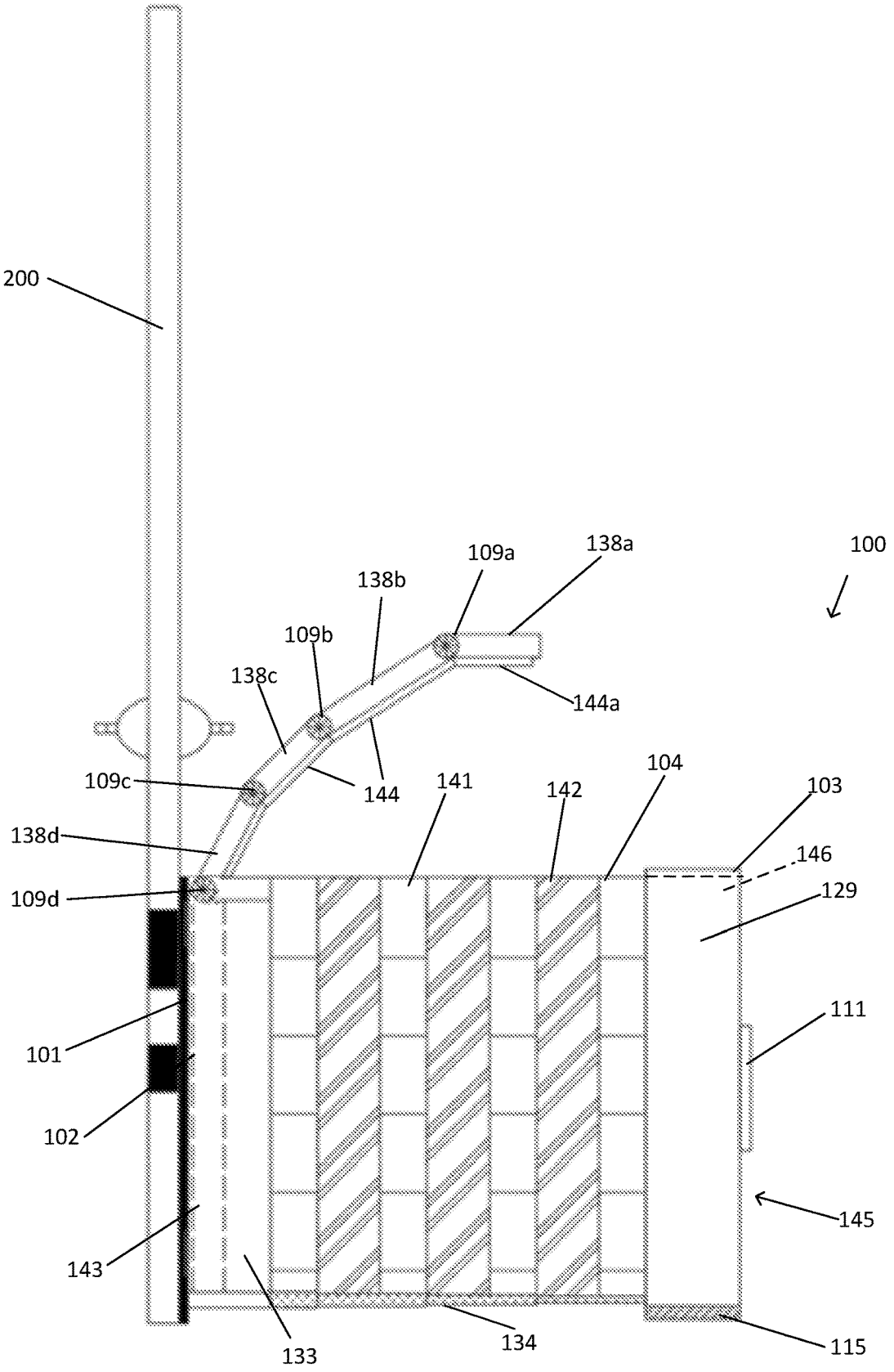
Figure 7D:
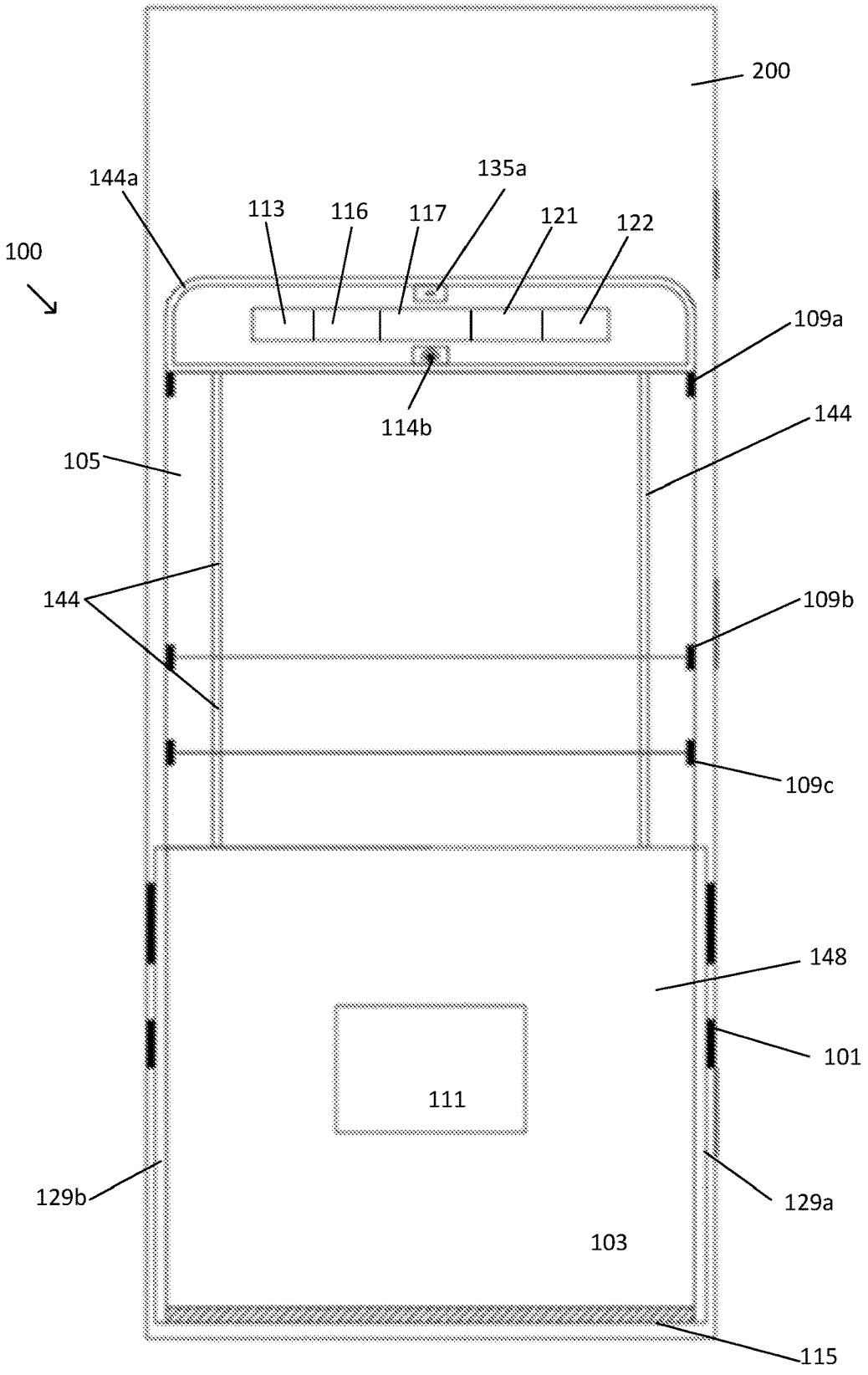
Figure 7F:
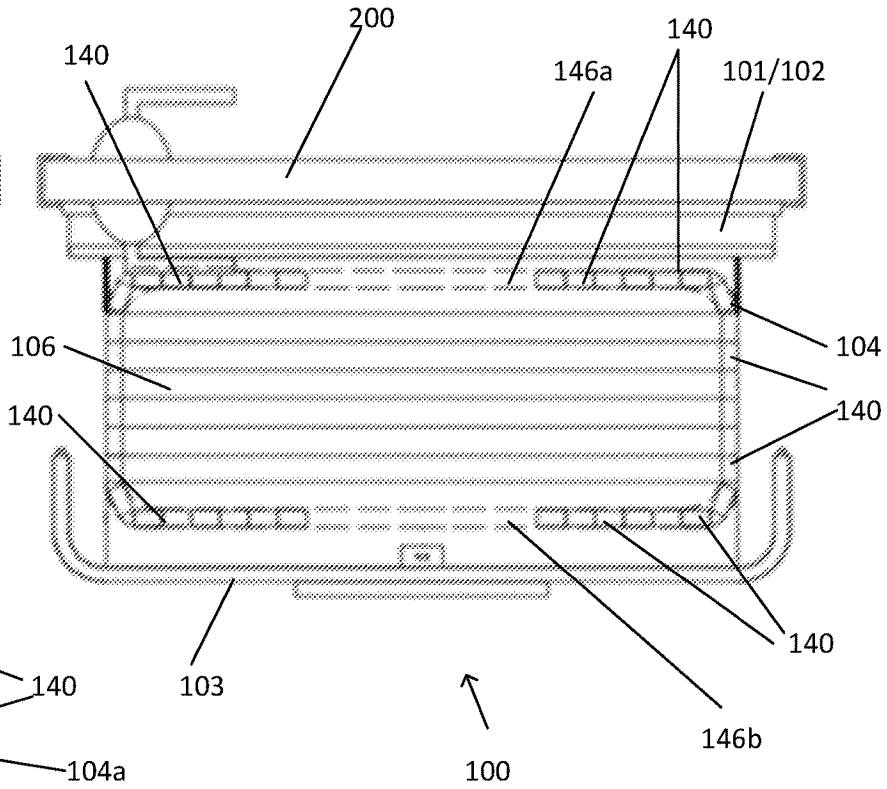
Figure 7E:
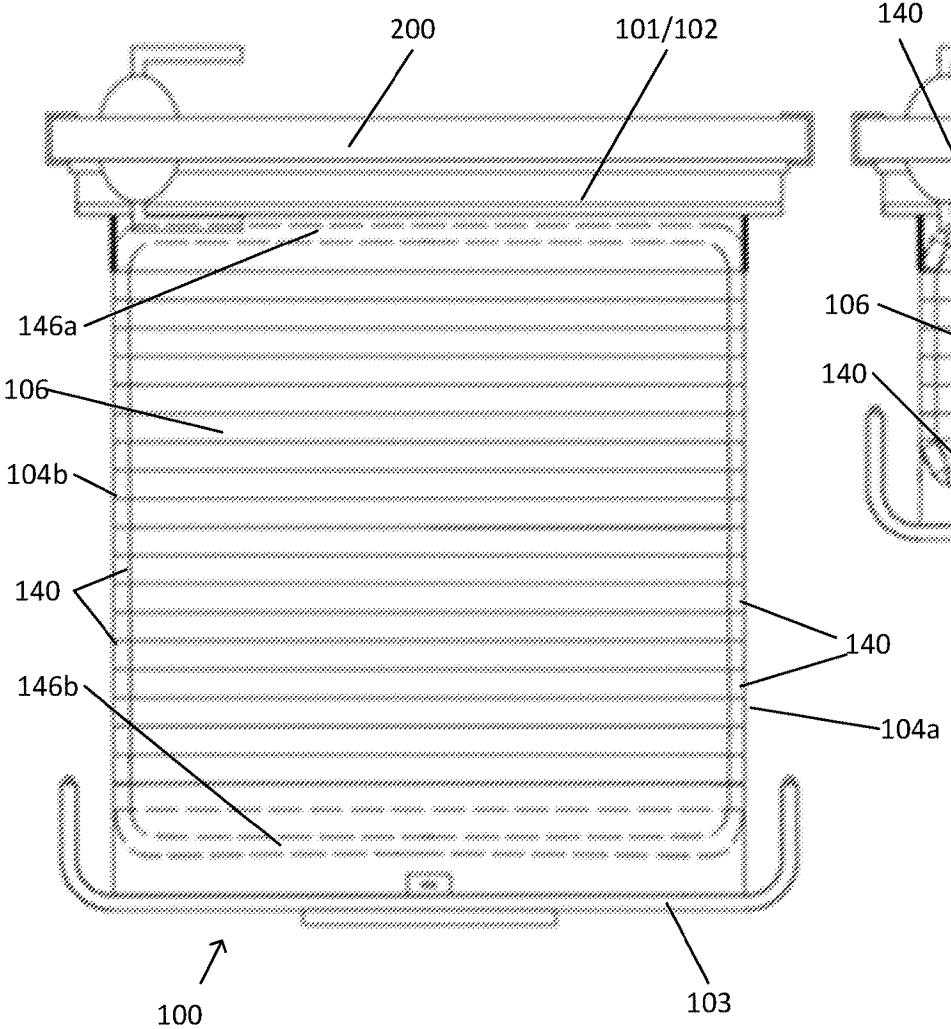

In examples, as illustrated in FIGS. 7A and 7E, fasteners 107 may be used in conjunction with a track. In examples, one or more fasteners 107 may be provided at an end portion of front panel 103. In examples, one or more fasteners 107 may be provided at an edge portion of front panel 103. In examples, back panel 102 or frame 101 may be configured to include a track 127 to fit an end portion or edge portion of front panel 103. In examples, the track 127 may include a complementary fastening structure 128, such as male-female fitting, for one or more fasteners 107 provided at the end portion and/or edge of front panel 103. In examples, as illustrated in FIGS. 7A and 7E, one or more fasteners 107 located at an end or edge portion 129 of front panel 103 can engage complementary fitting 128 provided in the one or more tracks 127 on back panel 102 and/or frame 101 when the end and/or edge portion 129 of front panel 103 is inserted in the track 127. In examples, a fitting 128 can engage a fastener 107 in any manner described above with respect to complementary fasteners 107 and can include hooks, male-female fittings, magnets, clamps, push button release lock, mechanism, or hooks, and like structures, or any combination thereof. In examples, fasteners 107 are pins that can engage complementary fittings 128.

In examples, as for example illustrated in FIGS. 2A-2E, side members 104 can include foldable panel system. The manner in which the foldable panel systems of side member 104 can extend is not limited. In some examples, the side panels 104 can fold. Panels can be made to fold by any suitable means as previously described, such as, for example, by using one or more hinges or other like pivoting junctions. The side panels can fold inward, i.e. toward the inside of the safe box 100. The foldable panel system can include panels, sections, or slabs configured to pivot outward, i.e. toward the outside of the safe box 100. In examples, the foldable panel system of a side member 104 may include two panels, sections, or slabs connected at a folding or pivoting junction 110. The pivot joint or fold can include a hinge 110 or like mechanism. The foldable panel systems are not limited to having two panels, sections, or slabs. The foldable panel systems can have three, four, ten, fifteen, twenty, thirty, forty, or more panels, sections, or slabs interconnected by pivoting structures such as hinges 110. The foldable panel systems of side member 104 may be connected to the front panel 103 and back panel 102 and/or fame 101 respectively. The connections with each of the front panel and back panel and/or frame 101 can also include a pivoting structure 110, such as a hinge or like structure.

In examples, the safe box 100 includes two foldable panel systems as side members 104 and optionally include one or more adjustable shafts 108 connected to the two foldable panel systems. Each of the one or more shafts 108 can be a mechanical shaft, pneumatic shaft, hydraulic shaft, or any combination thereof. The one or more shafts 108 can be used to control the unfolding of the side panels. In examples, an adjustable shaft 108 extends, the side panels 104 unfold into their extended position. Similarly, in examples, as the shaft 108 retracts, the side panels 104 can reach a folded position. The shaft 108 can be configured to lock in place. In examples, the shaft 108 can include one or more locking mechanisms to maintain an extended state, the retracted state, or both. By locking the shaft in an extended state, the shaft can help in maintaining the side panels 104 fully extended. The adjustable shaft 108 can be located anywhere that allows the side panels 104 to fold and unfold. In an example, the adjustable shaft 108 can be located at a bottom portion of the side panels 104 and connected to the inner surfaces of the side panels 104, i.e. the surfaces of the side panels facing inside the safe box 100, at or proximate to the region where the side panels 104 fold, i.e. at or proximate to pivoting junction or hinge 110. The expandable shaft 108 can be operated manually, by electric motor, or by remote control. In examples, remote control can be done via controller 116, directly, or both. In examples, the expandable shaft 108 can be controlled by controller 116.

In examples, side members 104 can include sheets in place of foldable panel systems. The sheets can be configured to fold and unfold as the front panel is moved towards or away from the back panel respectively.

In examples, as discussed later with respect to FIGS. 7A and 7C, one or more side members 104 can include a combination of panels and sheets.

In examples, as illustrated in FIGS. 2A-2E, a bottom member 106 can include a foldable panel system. In examples, the foldable panel system of bottom member 106 can be configured to fold inward, i.e. toward the inside of the safe box 100, or outward, i.e. toward the outside of the safe box 100, or both. Like the side panels 104, the foldable panel system of bottom member 106 can include two or more panels, sections, or slabs connected by pivoting mechanism or structure such as hinges. Also, similar to the side panels of side member 104, the foldable panel system of bottom member 106 can be connected to the front and back panels 103 and 102 by pivoting mechanisms such as hinges. In examples, as shown in FIG. 3, the bottom member 106 may include a sheet in place of a foldable panel system. In examples, the sheet of bottom member 106 can be configured to fold and unfold the front panel is moved towards or away from the back panel. As illustrated in FIGS. 6A and 6B, as discussed earlier, in examples, the sides and bottom of safe box 100 can also include one contiguous sheet material. In such an example, the contiguous sheet material can fold and unfold as the front panel moved towards or away from the back panel.

In examples, as discussed later with respect to FIGS. 7A, bottom member 106 can include a combination of panels and sheets.

Figure 2A:
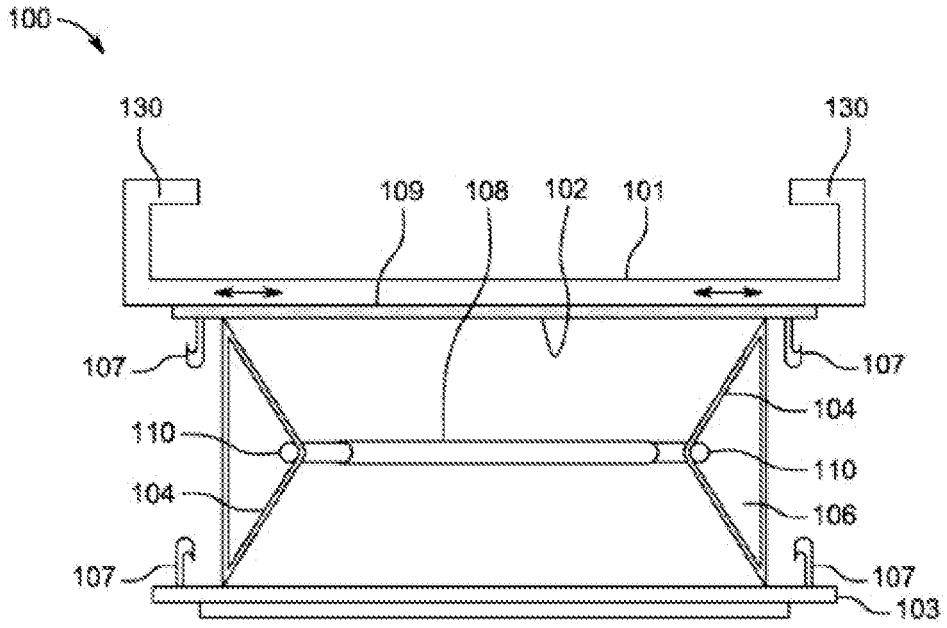
FIGS. 2A-2E illustrate different perspective view of examples of a safe box as described herein partially or fully extended state with and without showing a lid.
Figure 2B:
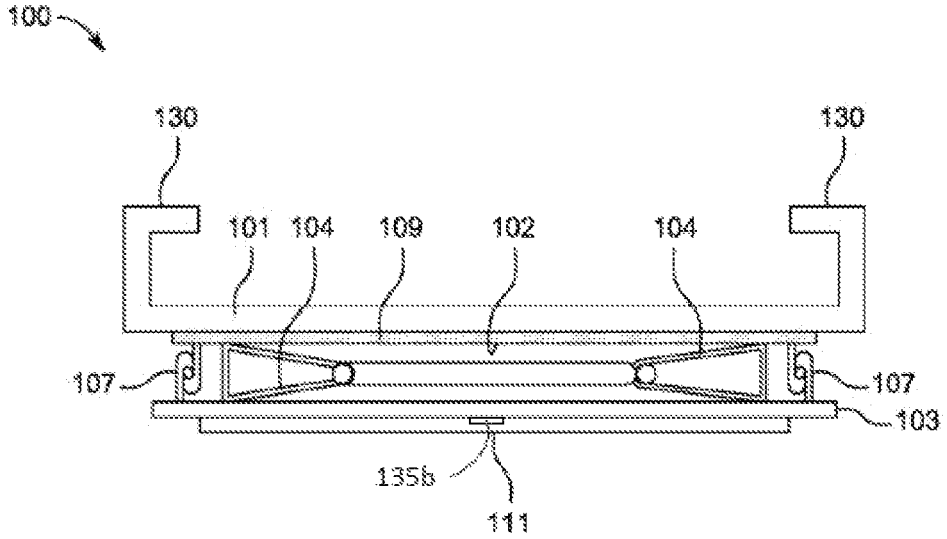
Figure 2C:
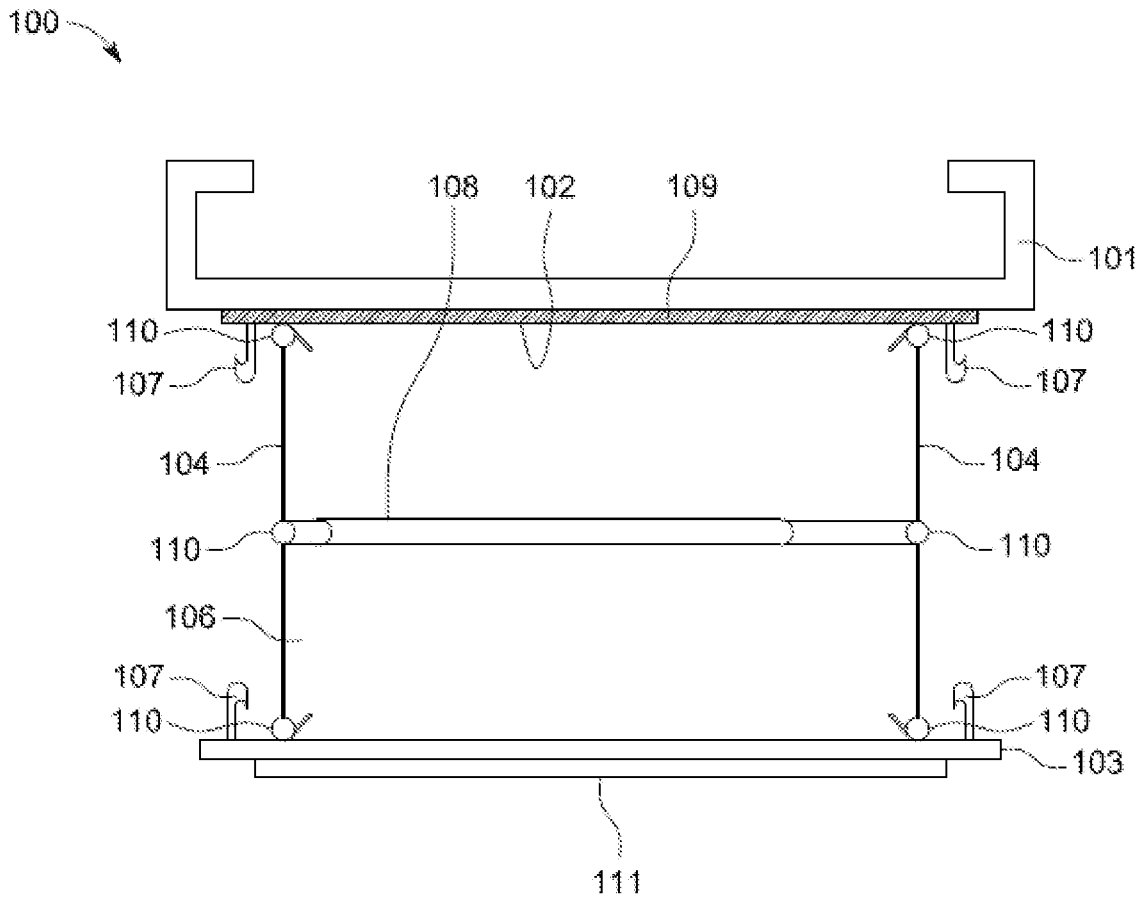
Figure 2D:
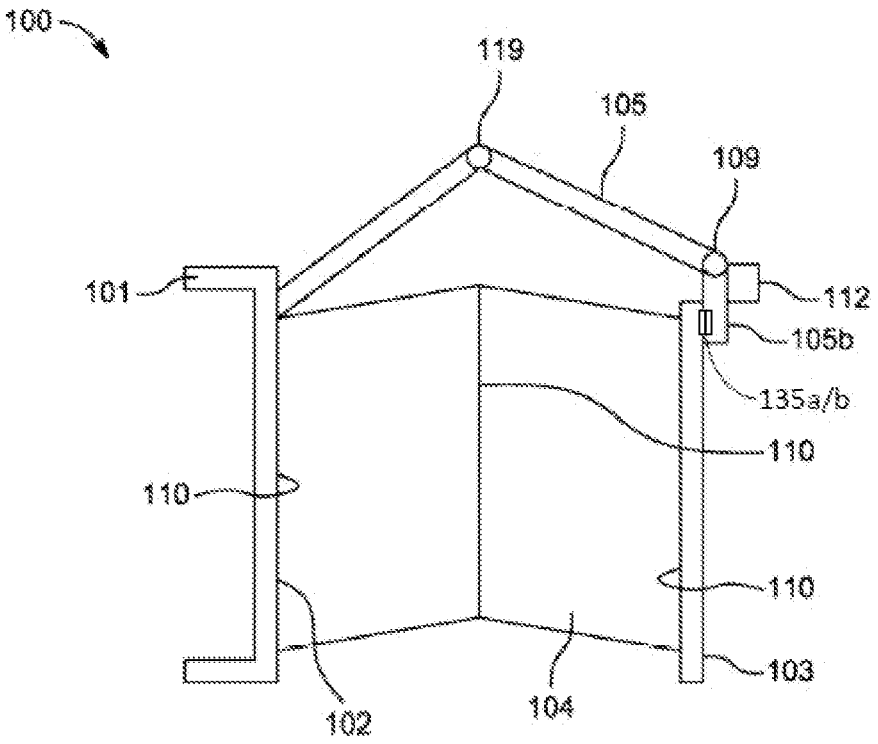
Figure 2E:
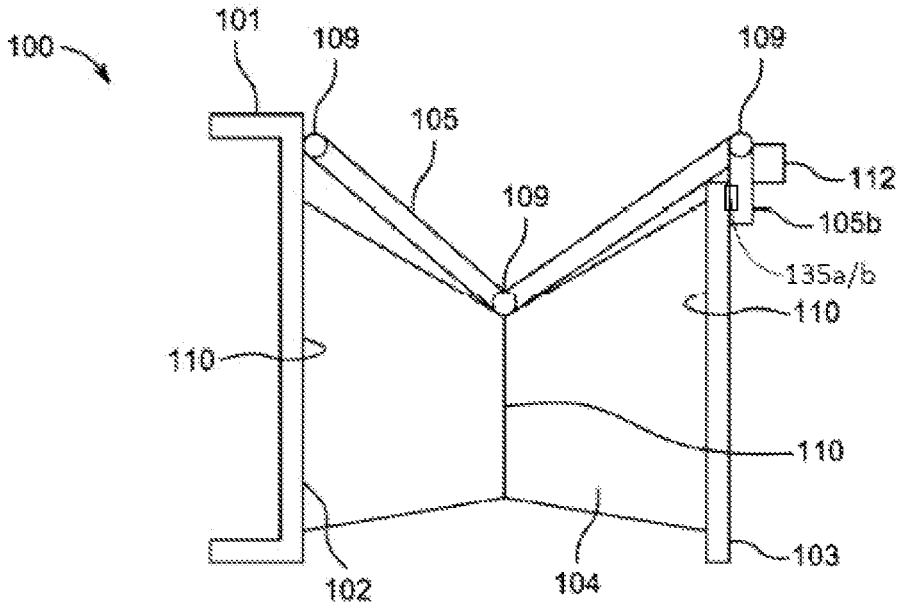
Figure 4A:
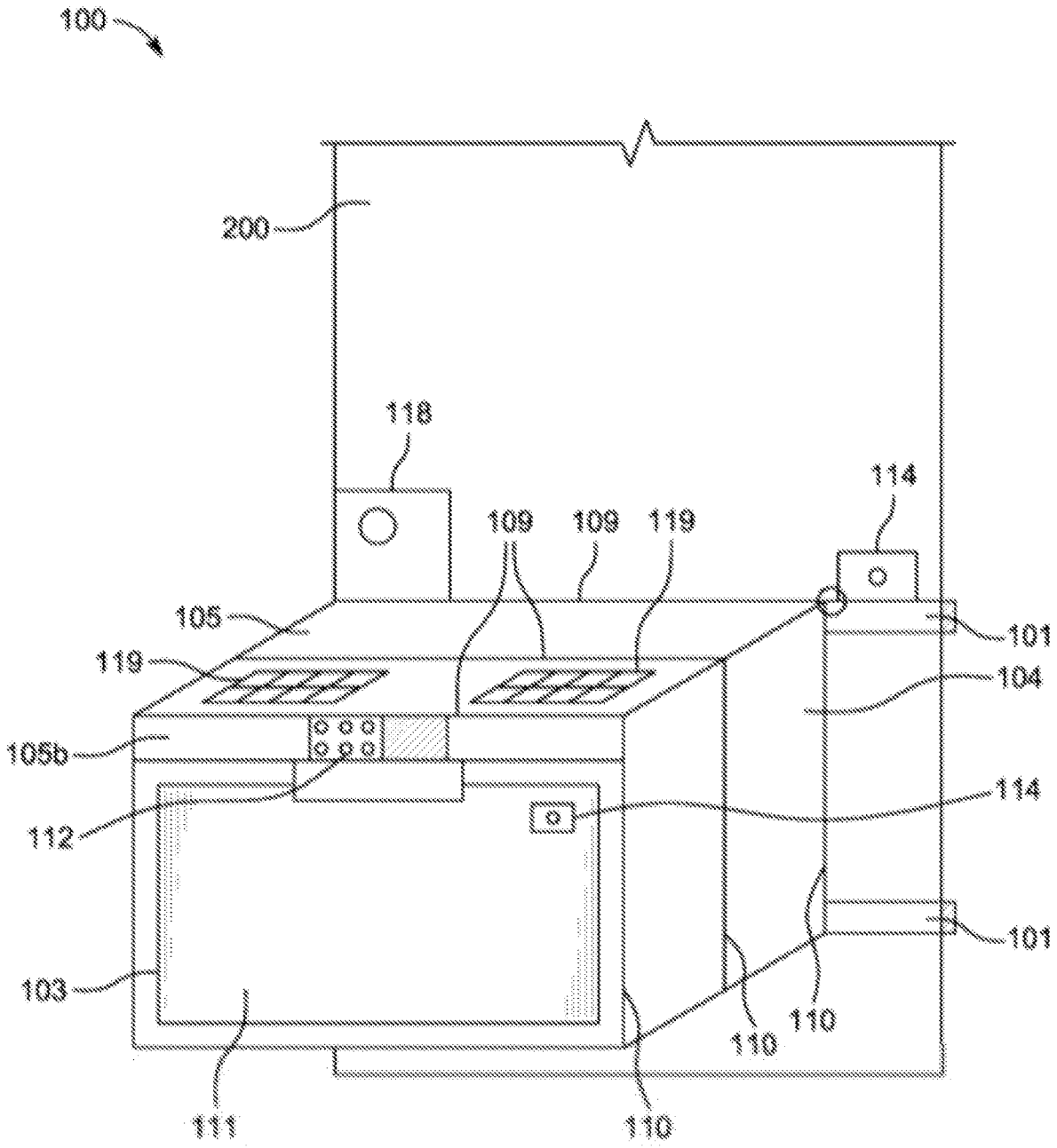
FIG. 4A is top perspective view of examples of a safe box fully extended.
Figure 4B:
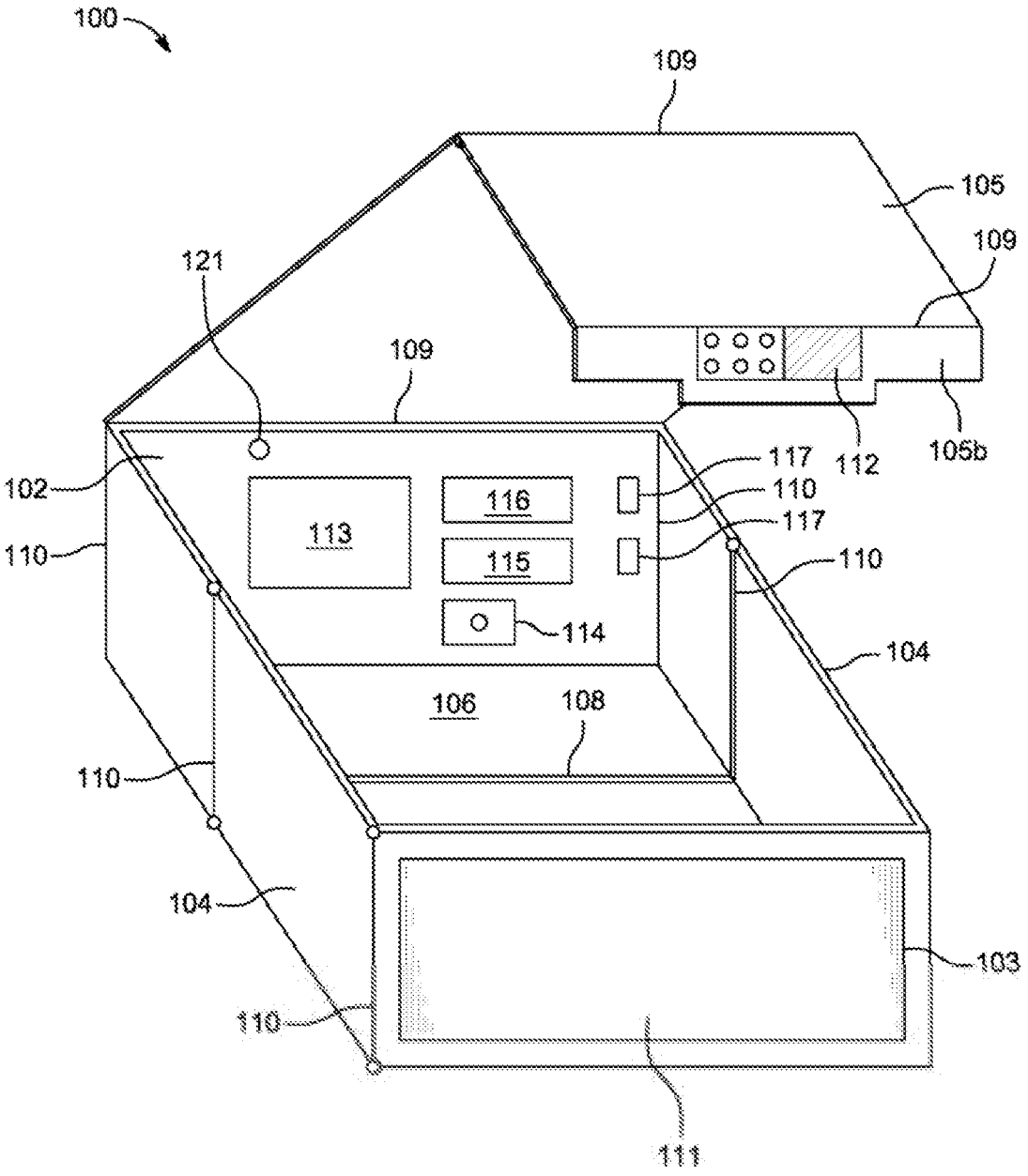
FIG. 4B is a perspective view of examples of a safe box with the bottom portion fully extended.

In examples, similar to the foldable panel system of side member 104, a lid 105 can include a foldable panel system with two or more panels, sections, or slabs connected by a pivoting mechanisms 109 such as hinges as shown in FIGS. 2D-2E and FIG. 4B. In examples, lid 105 may be an articulated lid. In examples, the articulated lid 105 can be connected to the back panel 102 by a pivoting mechanism such as a pivoting junction or hinge 109. The articulated lid 105 can be configured to fold inward, i.e. toward the inside of the safe box 100. The articulated lid 105 can be configured to fold outward, i.e. toward the outside of the safe box 100. In examples, the articulated lid 105 can include a front portion 105*b* to overlap at least partially a front portion of front panel 103, i.e. the portion facing outside the safe box 100. In examples, as illustrated later with respect to FIGS. 7A, articulated lid 105 may be configured to not overlap a front surface of front panel 103, not substantially overlap a front surface of front panel 103, or to overlap only a top edge portion of front panel 103.

In examples, articulated lid 105 can include one or more locks 112 configured to engage the front panel 103, side member 104, or both. In the example illustrated in FIG. 1, FIGS. 2D-2E, and FIGS. 3-5, lock 112 may engage with front panel 103. In examples, lock 112 can include a key lock, a smart lock, or a combination thereof. In examples, a lock 112 may include a mechanical fastener 135*a* configured to couple with a fastener 135*b* provide on front panel 103, side member 104, or both. In examples, locking mechanisms 135*a* and 135*b* may include clamps, hooks, J-hooks, loops, rings, screws, hole and pin systems, male-female fittings configured to engage when coupled, gears, magnets, electromagnets, or any combination thereof. In examples, locking mechanism 135*b* may provide a structure designed to be engaged by lock 135*a*. The lock 112 can include a dial pad, touch screen, scanner, microphone, other input device to allow for input of a code, password, fingerprints, iris scan, voice recognition, or other information by a user, and any combination thereof. In examples, lock 112 may include or be in communication with a memory. A memory may be used to store information necessary for identification. In examples, lock 112 may include or be in communication with a computational unit or a controller. In examples, lock 112 may be operated using a remote device. In examples, remote control can be done via controller 116, directly, or both. In examples, the smart lock can be configured to include or be in communication with a transceiver to enable it to communicate with a remote device. A remote device can be any device capable of wireless communication. In examples, a remote device can be a smart phone, a remote controller, a computer, or any like device. The communication can occur via any wireless means such as for example wi-fi, blue tooth, RF signals, and the like. In examples, the smart lock can be controlled by a controller 116. In examples, the lock 112 can be configured to automatically engage when the lid is closed.

As for example shown in FIGS. 1, 3, and 4, the front panel 103 can include a cover 111. In examples, the outside surface of the front panel, i.e. the surface facing outside the safe box 100 can include a cover 111 upon which a design can be imprinted. In examples, the design can help make the front panel 103 look like the surface of the fixture to which the safe box 100 is secured. In this manner the safe box 100 will be able to better blend with the overall design of the fixture.

In examples, cover 111 can include a display screen. In examples cover 111 may include a light emitting diode (LED) screen, a liquid crystal display (LCD), a plasma screen, or any other electronic screen that may be available. In examples, cover 111 may include a touch screen. In examples, cover 111 may be configured to display an image, text, or any combination thereof. In examples, cover 111 may include or be in communication with a memory. A memory may be used to store information that may be used for the display. In examples, cover 111 may include or be in communication with a computational unit or a controller. In examples, cover 111 can be configured to not display anything. In examples, cover 111 can be configured to display an image and/or text at selected times. In examples, cover 111 may include an input means. In examples, an input means can be the cover 111 itself configured as a touch screen. In examples, a separate input device such as a keyboard, mouse, or other like input device may be connected to cover 111 to enter input information. In examples, cover 111 may be controlled by a remote device. In examples, cover 111 may include or be in communication with a transceiver to enable communication with a remote device. In examples, remote control can be done via controller 116, directly, or both. In examples, a remote device can be a smart phone, a remote controller, a computer, or any like device. The communication can occur via any wireless means such as for example wi-fi, blue tooth, RF signals, and the like. In examples, the cover 111 can be controlled by a controller 116.

As shown for example in FIGS. 4A and 4B, the safe box 100 can further include one or more cameras 114. One or more cameras 114 can be located inside the safe box 100, outside the safe box 100, or a combination thereof. In an example, a camera 114 is located outside the safe box 100 to monitor the environment outside the safe box 100. In an example, a camera 114 can be integrated into or installed on the outside of the front panel. In an example, a camera 114 can be integrated into or installed on top of the lid 105. In an example, a camera 114 is configured to be installed on the surface of the support 200. When installed on the front panel, lid, or support, a camera can be connected by any known means such as adhesive, screws, bolts, or other fastening device. The camera can further be tethered to the safe box 100 by a leash 122 or like structure so that it cannot be safely connected to the safe box 100.

In examples, lid 105 may include one or more cameras 114. In examples, the cameras can include a charge-couple device (CCD), a CMOS sensor or any like device. In examples, one or more cameras 114 can be infrared cameras. In examples, lid 105 may include a camera facing outside of safe box 100. In examples, lid 105 may include a camera facing inside of safe box 100. In examples, lid 105 may have one or more infrared cameras configured to capture images outside of safe box 100 and one or more infrared cameras configured to capture images inside of safe box 100.

As shown in FIG. 3, the safe box 100 can include a scanner 120 or other like reader that can be used to read an image or symbology on the box, such as a serial number or UPC code, QR code, or other type of image. In examples, the scanner 120 can be a QR scanner or similar device. The scanner 120 can read the code and then connect to processor or controller 116 than can then send the information to the owner confirming receipt and identification of the package.

As shown in FIG. 4B, the safe box 100 can include a sterilizer 113. The sterilizer 113 can be included on the inside surface of the back panel, i.e. the surface facing the inside the of the safe box 100. The sterilizer 113 can include any means to kill bacteria from inside the safe box 100 and any contents placed therein. In an example, the sterilizer 113 can include a UV radiation lamp. The sterilizer 113 can include a heating device. The sterilizer 113 can be independently operated. In examples, sterilizer 113 can be operated remotely. In examples, remote control can be done via controller 116, directly, or both. In examples, remote control can be accomplished as described for the lock, i.e. via wi-fi, RF signals, blue tooth and the like by way of a transceiver using a remove control, smart phone, computer, or computing device. In examples, the sterilizer 113 can be controlled by controller 116. In examples, the controller 116 can be programmed to activate sterilizer 113 automatically upon locking of the safe box 100 and/or upon detection of an object placed inside the safe box 100.

As shown in FIG. 4B, in examples, safe box 100 can include one or more sensors 117 to monitor proper closure of the lid or top plate, presence of an object inside the safe box 100, tempering with safe box 100, sense the environment inside safe box 100, or a combination thereof. In examples, the sensors can include thermal sensors, motions sensors, contact sensors, inclination or orientation sensors, lock sensors, or any combination thereof. The one or more sensors 117 can be located in any convenient location inside and/or outside the safe box 100. In examples, a sensor can be configured to detect the presence of an item, package, or parcel inside the box when the item, parcel, or package touches a portion of bottom member 106 of safe box 100. The one or more sensors can send a signal to a controller or processor 116, also included in the safe box 100.

In examples, the processor 116 can include a transceiver and configured for wireless communication via wi-fi, blue tooth, RF signal or the like. The controller 116 including memory can be configured to control all the electronic elements of the safe box 100. The controller 116 can be implemented via hardware, software, or combination of both. Controller 116 may be in communication with one or more of the other electronic devices described herein. In examples, all electronic components described herein that are part of safe box 100 may be controlled by controller 116. In examples, controller 116 may include information and instructions, and/or may be configured to retrieved information and instructions either from memory and/or from a remote source for the operation of all other electronic components. In examples, each electronic component described herein may include or be configured to access, from memory or from a remote source, at least in part instructions and information necessary for its respective operation.

For controller 116, smart lock 112, cover 111, sterilizer 113, cameras 114, sensors 117, and for any other electronic component described herein, the functions described herein may be stored as one or more instructions or code on a non-transitory computer-readable or processor-readable storage medium. The steps of a method or algorithm disclosed herein may be embodied in a processor-executable software module, which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM, CD-ROM or other optical disk storage, magnetic disk storage or other magnetic storage devices, or any other tangible storage medium that may be used to store desired program code in the form of instructions or data structures and that may be accessed by a computer or processor. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

In examples, the controller 116 can be controlled remotely. In examples, the controller 116 can be configured to follow preset operations or receive input for operation based on signals sent from the camera, sensors, lock, or any combination thereof.

In examples, the controller 116 can be configured to operate in conjunction with a software application. The application can be downloaded on a user device to allow control and communication with controller 116. The application can be configured to receive alerts. The application can be configured to lock and unlock smart lock 112. The application can be configured to stream video fee from the one or more cameras 114. The application can be used to select a display such an image, message, or any combination thereof on cover 111. The application can be used to control, set off, and/or shut off an alarm. Other features can also be implemented.

Figure 5:
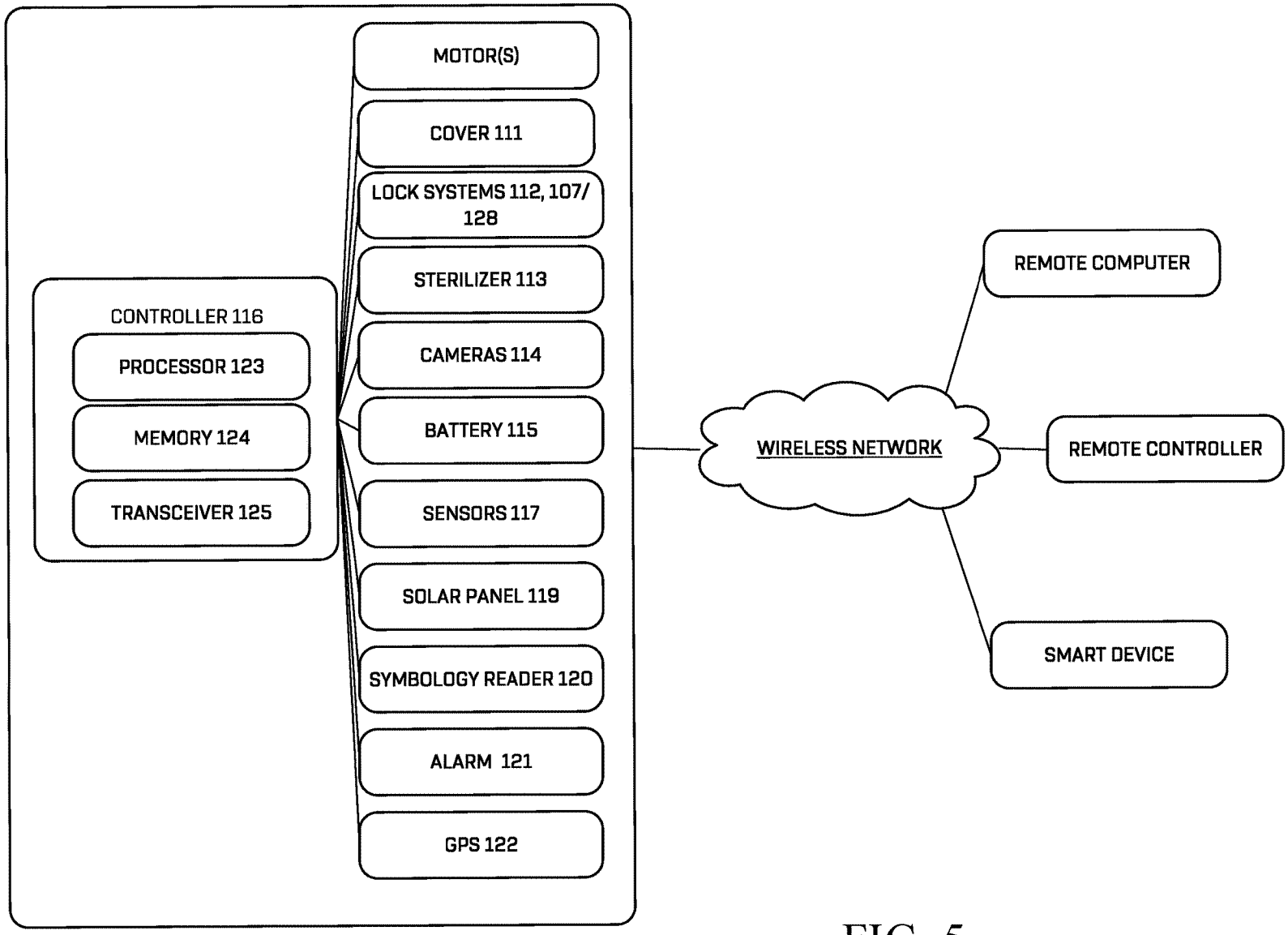
FIG. 5 is a diagram of exemplary logic systems that may be used in a safe box as described herein.

In examples, all electronic devices described herein, including the cover 111, lock 112 (if a smart lock), sterilizer 113, cameras 114, battery 115, sensors 117, solar panel 119, scanner/symbology readers 120, alarm 121, GPS 122, lock system 107/128, and any motors described herein may be controlled via controller 116, may operate independently, or both. Controller 116 may be in communication with any one of the one or more electronic devices via a wire connection, wireless connection, or both. In examples, communication between devices can be achieved using one or more transceivers or like device. In examples, as illustrated in FIG. 5 a controller 116 includes one or more processors 123, one or more memory 124, and one or more transceivers or like device 125. Information, logic and software applications for the control of one or more electronic devices may be stored in one or more memory 124. In examples, remote control of any of these electronic devices may be accomplished by remote control, by a remote computer or computing device, a smart device such as a smart phone or any combination thereof. Remote control can be accomplished via a wireless network as described. Communication form a remote device can be transmitted to controller 116 to then control one or more electronic devices. In examples, one or more of the electronic devices may be configured to operate independently in addition to and/or instead of receiving control signals by controller 116. In examples, one or more of the electronic devices may include similar components to the controller 116 as described herein. For example, one or more of the electronic devices may include any one or more processors, memory with stored logic and/or software for operation, and transceivers or like device for wireless or wired communication. In examples, the controller 116 and one or more electronic devices may share components such as processors, memory, and/or transceiver or like device.

In examples, the controller 116 can be configured to send a notification to the user when a package or parcel is detected inside the safe box. The notification can be delivered electronically. If an app is used, the notification can be sent via the software application.

The safe box 100 can be equipped with a GPS tracker. The GPS tracker 122 can be in communication with or be integrated to controller 116. The GPS tracker 122 would preferably be hidden or provided not in a conspicuous manner. The GPS tracker 122 can be used to track the location of the safe box 100 in the event safe box 100 is misplaced or stolen. In examples, a GPS tracker 122 may also be used to locate safe box 100 for delivery purposes.

In examples, the safe box 100 can be equipped with an alarm 121 that can be visual, audio or a combination thereof. The alarm 121 can be configured to receive sensor information directly or be controller by controller 116. In examples, the alarm 121 can be configured to signal whether the lid or top panel is not safely locked, whether the package does not properly fit within the safe box 100, whether there is any tempering with the safe box 100, or any combination thereof. In examples, alarm 121 may be configured to also generate a signal that is sent to a remote device to alert of an event. The signal alert may be sent directly by alarm 121, it may be sent by controller 116 in response of receiving the signal from alarm 121, or both.

Powering the electrical components described above, the safe box 100 can include a power source 115 as illustrated in FIG. 4B. In an example, the power source 115 can be a battery, a gel pack, a capacitor or like device. In examples, the power source 115 may be removable. In examples, the power source 115 may be removed from safe box 100, charged, and then reinstalled in safe box 100. The power source 115 can be located inside the safe box 100. The power source can include a wired connection to an electrical source that may be on the fixture or surrounding area. The safe box 100 can optionally include one or more solar panels 119 to recharge the power source and/or to power the safe box 100.

The overall size of the safe box 100 is not particularly limited. In examples, the safe box 100 configured to be removably installed is a size that can be easily carried by a person without the use of machinery. In an example, the safe box 100 can be about 30 inches wide, 30 inches deep when fully expanded, and 30 inches tall. The front panel can be oversized to better cover the elements behind it. For example, if distance between the two side members when fully extended is 30 inches, the front panel can be 35 inches wide. In examples, where the safe box is totally expanded opened, the dimensions can be about for a 3 foot door application, i.e. about 36 inches in length, 30 inches in width, and 30 inches in depth. The size can vary slightly on certain measurements and configurations based on different applications. When the secure box is in a collapsed stated, i.e. completely recessed, in a non-use locked position, the depth extruding from the door or any structure adhered to can be about 4 inches to 8 inch. Other sizes can also be implemented. In examples, the size of a deployed safe box 100 may vary depending on whether the safe box 100 is fully or partially expanded.

FIGS. 7A-7G illustrate additional examples of a safe box 100 as described herein. FIG. 7A is a top down view of a safe box 100 secured to a support 200, such as a door. As described earlier, in examples, safe box 100 may include a frame 101, one or more side members 104, a bottom member 106, a lid 105, a back panel 102, and a front panel or facia 103. In examples, frame 101 and back panel 102 may be integrated into as single structure that performs the functions described for frame 101 and back panel 102. In examples, as illustrated in FIG. 7A, when lid 105 is in the retracted or stowed state it extends over the top portion of back panel 102.

In examples, frame 101 may include one or more adjustable members or brackets 130 as previously described. In examples, adjustable members or brackets 130 can wrap around at least a portion of support 200. In examples, frame 101 may include a portion 131 that contact a front surface of support 200. In examples, portion 131 may be connect to a back panel 102. As for example illustrated in FIG. 7B, one or more mechanical locks 126 such as a rack and pinion gear, an adjustable cable reel, or any like mechanism to fix the length of the frame 101 in place once installed. In examples, the one or more mechanical locks 126 may be accessed from back panel 102 as illustrated in FIG. 7B.

In examples, a back panel 102 may be separate from or integrated with frame 101. In examples, frame 101 can function as back panel 102. As illustrated in FIG. 7B, in examples, back panel 102 can be securely fixed to frame 101 and portion 131 of frame 101. In examples, mechanical locks 126 can assist in securing back panel 102 to frame 101. In examples, additional securing means may be used to affix back panel 102 to frame 101 as previously discussed. In examples, back panel 102 and/or frame 101 can include one or more tracks or U-channels 127 to engage one or more end portions 129 of front panel 103 as discussed below. In examples, back panel 102 and/or frame 101 may include one or more securing means 132 configured to attach one or more components of safe box 100. In examples, securing means 132 may include clamps, hooks, bearings such as pop-in bearings, male-female fittings, gears, screws, screw holes, bolts, fittings, magnets, adhesives, or any other suitable like structure to securely affix any one or more of the components of safe box 100 to back panel 102 and/or frame 101. In examples, back panel 102 and/or frame 101 may provide structural integrity to support safe box 100 and its contents.

As illustrated in FIGS. 7B and 7C, in examples, frame 101 and/or back panel 102 may include as border 133 extending from support 200. In examples, border 133 may extend from support 200 (i.e. have a width) of between one inch and twenty inches. In examples, the width of border 133 may be one inch or greater and be equal to or less than 20 inches, 15 inches, 10 inches, 9 inches, 7 inches, 7 inches, 6 inches, 5 inches, 4, inches, 3 inches, or 2 inches. In examples, border 133 may extend along a side of frame 101 and/or back panel 102. In examples, border 133 may extend along both sides of frame 101 and/or back panel 102. In examples, border 133 may extend along a bottom portion of frame 101 and/or back panel 102. In examples, border 133 may extend along both sides and along a bottom portion of frame 101 and/or back panel 102. In examples, border 133 may be formed of the same material as described for frame 101, back panel 102, or any panel structure described herein.

In examples, front panel or facia 103 may include one or more of the features previously described. As illustrated in FIGS. 7A-7D, in examples front panel 103 may include one or more of end portions 129 along its sides, a rim 146, one or more locking mechanism 135*a*, a front cover 111, and any combination thereof. In examples, an end portion 129 may extend the full height of front panel 103 or a partial height of front panel 103.

In examples, one or more end portions 129 of front panel 103 may be curved. In examples, a first end portion 129*a* and a second end portion 129*b* of front panel 103 define a middle portion 145 of front panel 103. In examples, middle portion 145 of front panel 103 can be parallel to back panel 102, frame 101 or both.

In examples, one or more end portions 129 of front panel 103 may be configured to turn or bend toward back panel 102, frame 101, or both. In examples, one or more end portions 129 of front panel 103 may be configured to fit in one or more tracks or U-channels 127 provided in back panel 102 and/or frame 101. In examples, when safe box 100 is fully collapsed, in a stowed state, at least a portion of an end portion 129 of front panel 103 are inserted into one or more tracks or U-channels 127. In examples, one or more fasteners 107 may be provided along a surface of an end portion 129. In examples, one or more fasteners 107 may be provided at the surface of end portion 129 that faces back panel 102, frame 101, or both. In examples, one or more fasteners 107 may be provided on at least the portion of an end portion 129 of front panel 103 that is inserted into one or more tracks or U-channels 127 when the safe box 100 is collapsed, in the stowed state. The nature and character of fasteners 107 has already been described. In examples, one or more fittings 128 may be provided on at least a portion of the one or more tracks 127. In examples, a fitting 128 may be a cavity or hole configured to engage a fastener 107. In examples, a fitting 128 may be a fastener like 107 but configured to engage a fastener 107 provided on an end portion 129. In examples, fitting 128 and fastener 107 may be configured to mate. In examples, fastener 107 is a pin like structure, and fitting 128 is a hole like structure. In examples, fastener 107 and fitting 128 may be configured to engage when pressed together. In examples, fastener 107 and fitting 128 when already engaged may be configured to disengage when pressed together. In examples, the engagement, disengagement, or both of fastener 107 and fitting 128 can be controlled manually, automatically, by controller 116, by remote control, or any combination thereof. In examples, remote control can be done via controller 116, directly, or both. Remote operation can be accomplished by employing a transceiver as similarly described earlier with respect to other components.

In examples, rim 146 can extend from front panel 103 toward back panel 102. In examples, rim 146 may circumscribed middle portion 145 of panel 103 extending between end portions 129*a* and 129*b*. In examples, the width of rim 146 extending from front panel 103 to back panel 102, frame 101 or both can be the same as the width lid 105 extends from support 200 when in the fully stowed position. In examples, rim 146 can improve structural integrity of safe box 101. In examples, the top portion of rim 146 may be below a top edge of front panel 103. In examples, a top portion of rim 146 is configured to fit under lid 105 when safe box 101 is fully collapsed. In examples, a bottom portion of rim 146 is configured to connect to, hold, support, or any combination thereof a power source 115. In examples, power source 115 may include a battery. In examples, rim 146 can be made of any material as previously described for any panel discussed herein.

In examples, front panel 103 may include one or more locking mechanisms 135*b* to engage directly or indirectly one or more locks 112 and/or 135*a* provided on lid 105. In examples, locking mechanism 135*b* may provide a structure designed to be engaged by locking mechanism 135*a* of lock 112. In examples, locking mechanism 135*b* may be controlled by lock 112. In examples, locking mechanism 135*b* may be a passive structure. In examples, locking mechanism 135*b* may be provided on rim 146. In examples, locking mechanism 135*b* may be provide on front panel 103.

In examples, front panel 103 may include a cover 111. As described earlier, in examples, cover 111 may include an ornamental cover. Also, as described earlier, in examples, cover 111 may include an display screen such as an LED screen, an LCD, a plasma screen or any other electronic display device. In examples, cover 111 may be controlled either manually, automatically, or remotely to display any image, message, or a combination of both.

In examples, as illustrated in FIGS. 7A and 7C, one or more side members 104 may include alternating rows of panels 141 and sheets 142. In examples as illustrated, safe box 100 may include two side members 104, each having alternating rows of panels 141 and sheets 142. In examples, the one or more side members 104 can be configured to protract and retract in an accordion type fold. In examples, the one or more members 104 can be configured to protract and retract in a curtain style manner.

The protraction and retraction of the one or more side members 104 may be effectuated by any suitable mechanism. In examples, safe box 100 may include one or more telescoping arm 134. In examples, safe box 100 may include two telescoping arms 134*a* and 134*b*. In examples, a telescoping arm can be located proximate to a side member 104 and a bottom member 106. In examples, a telescoping arm 134 can be operably connected to side member 104. In examples, a telescoping arm 134 can be operably connected to bottom member 106. In examples, a telescoping arm 134 may be operably connected to a side member 104 and bottom member 106. In examples, safe box 100 may include two telescoping arms 134*a* and 134*b*, a first telescoping arm 134*a* being operably connected to a first side member 104*a* and to bottom member 106, and a second telescoping arm 134*b* being operably connected to a second side member 104*b* and to bottom member 106. In examples, a telescoping arm 134 may be operably connected only to side member 104. In examples, a telescoping arm 134 may be operably connected to an end portion of side member 104 that is opposite a second end portion of side member 104, the second end portion of side member 104 being adjacent the bottom member 106. In examples, a telescoping arm 134 may be operably connected to an end portion of each side member 104 that is respectively opposite a second end portion of each side member 104, the second end portion of each side member 104 being adjacent the bottom member 106. In examples, safe box 100 may include more than two telescoping arms. In examples, safe box 100 may include one, two, three or four telescoping arms.

In examples, a telescoping arm 134 can be arranged along any portion of a side member 104. In examples, as a telescoping arm 134 extends it may be configured to cause a side member 104 that is operably connected thereto to protract. In examples, as a telescoping arm extends an operably connected side member 104 unfolds accordion style. In examples, as a telescoping arm retracts it may be configured to cause a side member 104 that is operably connected thereto to retract. In examples, as a telescoping arm retracts an operably connected side member 104 folds accordion style. In examples, accordion style indicates a folding arrangement where alternating rows of panels 141 and sheets 142 fold onto each other in a zig-zag manner.

Figure 7G:
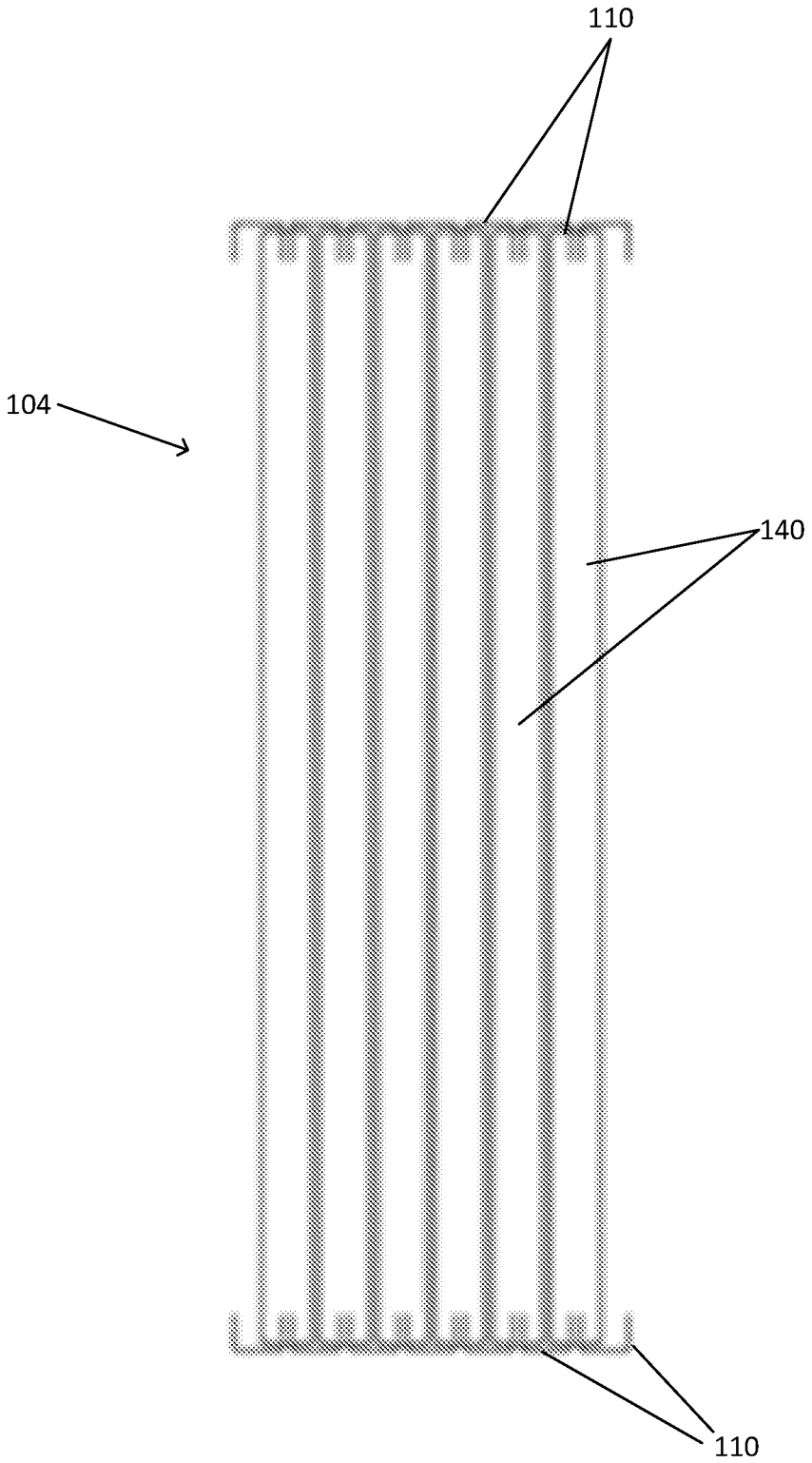

In examples, instead of protracting and retracting in an accordion style, one or more side members 104 may be configured to protract and/or retract by way of a track or slide 146. In examples, as illustrated in FIGS. 7E to 7G, one or more side members 104 may be configured to include a series of narrow panels, sections, or slabs 140 pivotally joined together. In examples, the pivotal joints 110 may include a hinge. In examples, the pivotal joints 110 are U-shaped hinges that connect at an edge or end portion of a panel, section or slab 140. In examples, the width of each panel, section, or slab 140 is not particularly limited but should be properly sized to allows for the functionality described herein. In examples, the width of a panel, section or slab 140 may be at least 0.1 inches or greater and no greater than 5 inches, 4 inch, 3 inches, 2 inches, or 1 inch. In examples, the width of each section, panel, or slab 140 is 1 inch. Each panel, section, or slab 140 may be made of the same material as previously described for a panel.

In examples, side member 104 be operably engaged to a track or slide 146 via any suitable means. In examples, one or more side members 104 may engage a track or slide 146 by way of one or more engaging means such as bearings, gears, wheels, pinions, or any like system, or any combination thereof. In examples, the engaging means may be provided at an end portion of a section, panel, or slab 140 of a side member 104.

In examples, the track or slide 146 may include at least a portion of a track on the back panel 102 and/or frame 101, on the front panel 103, or both. In the illustrated examples, a track or slide 146*a* is provided at least on the back panel 102 and/or frame 101 and a track or slide 146*b* is provided at least on the front panel 103. In examples, as the front panel 103 is distanced from back panel 102 and/or frame 101, side member 104 is configured to travel out of one or more tracks or slides 146 and assume a longitudinal direction that is perpendicular to back panel 102 and/or frame 101, front panel 103, or both. In this manner, side member 104 is protracted to form a side of an opened safe box 100 as, for example, illustrated in FIG. 7E. Conversely, in examples, as the font panel 103 is brought closer to back panel 102 and/or frame 101, side member 104 is configured to travel into one or more tracks or slides 146 and assume a position in which at least a portion of side member 104 is arranged parallel to back panel 102 and/or frame 101, front panel 103, or both as, for example, illustrated in FIG. 7F. In examples, in the stowed position and in the deployed position, at least some of the panels, sections, or slabs 140 of side member 104 may be oriented to have their widest surfaces along the same plane. In examples, side member 104 may be configured so that when in the stowed position, the panels, sections, or slabs 140 of side member 104 may be folded onto each other in an accordion manner.

In examples, a telescoping arm 134 may be connected to front panel 103. In examples, a telescoping arm 134 may be connected to back panel 102 and/or frame 101. In examples, a telescoping arm 134 may be connected at a first end to back panel 102 and/or frame 101 and at a second, opposite end to front panel 103. In examples, as a telescoping arm 134 extends it may cause at least a portion of the front panel 103 to translate away from back panel 102 and/or frame 101. In examples, as a telescoping arm 134 retracts it may cause at least a portion of the front panel 103 is translated toward back panel 102 and/or frame 101.

The one or more telescoping arms 134 may be operated manually, electronically, hydraulically, mechanically, automatically, independently, or any combination thereof. In examples, the telescoping arm 134 may be configured to lock in position once extended and/or retracted to a given amount. In examples, each telescoping arm 134 can be configured to fully extend, fully retract, partially extend, partially retract, or any combination thereof.

In examples, the extension and retraction of a telescoping arm 134 may be configured to be performed manually by pulling from or pushing against the front panel 103. In examples, the extension and retraction of a telescoping arm 134 may be caused by a motor (not shown). In examples, the extension and retraction of a telescoping arm 134 may be caused by a pulley system, gears, hydraulics, electric motor, or other like mechanism. In examples, the extension and retraction of a telescoping arm 134 can be controlled remotely. In examples, remote control can be done via controller 116, directly, or both. Remote control can be performed as similarly described earlier with respect to other components. In examples, remote communication can occur via any wireless means such as for example wi-fi, blue tooth, RF signals, and the like. In examples, operation of a telescoping arm 134 may be controlled by a remote controller, smart device such as a smart phone, computer or other computing device. In examples, a telescoping arm 134 can be operated by controller 116. In examples, a telescoping arm operation system may include memory, logics, instructions, a controller or other processing unit, a transceiver or may be in communication with a memory, logics, instructions, a controller or other processing unit, a transceiver that may be used for remote control and/or operation of the telescoping arm and of any motor used to operate the telescoping arm.

In examples, as illustrated in FIGS. 7A, bottom member 106 may include alternating rows of sheets 136 and panels 137. In examples, the bottom member 106 can be configured to protract and retract in an accordion type fold. In examples, the bottom member 106 can be configured to protract and retract in a curtain style manner. In examples, the bottom member 106 can be configured to protract and retract by way of a track system.

In examples, the bottom member 106 may be operably connected to one or more telescoping arms 134. The operation, control, and arrangement of the one or more telescoping arms 134 may be as already described earlier. In examples, the bottom member 106 may be operably connected to two telescoping arms. In examples, a first end portion of bottom member 106 is operably connected to a first telescoping arm 134*a*, and a second end portion, opposite the first end portion, of bottom member 106 is operably connected to a second telescoping arm 134*b*. In examples, as a telescoping arm 134 extends it can be configured to cause at least a portion of bottom member 106 to protract. In examples, as a telescoping arm 134 retracts it can be configured to cause at least a portion of bottom member 106 to retract. In examples, the one or more telescoping arms 134 can cause at least a portion of bottom member 106 to fully protract, fully retract, partially protract, partially retract, or any combination thereof. In examples, the bottom member 106 is operably connected to a telescoping arm that is also operably connected to a side member 104. In examples, bottom member 106 may be operably connected to an independent telescoping arm not connected to a side member 104.

Figure 7H:
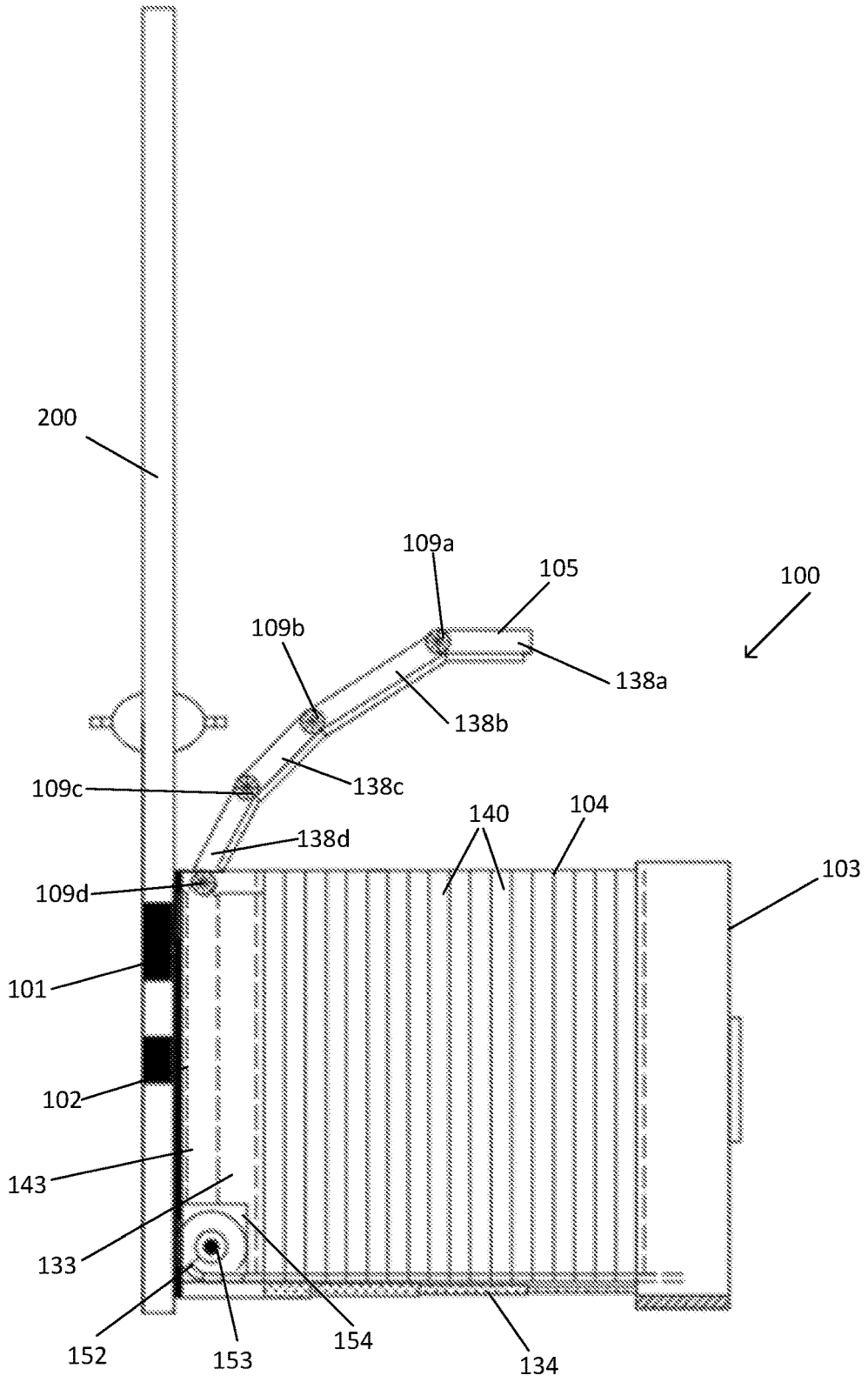

In examples, as illustrated in FIG. 7H, bottom member 106 may be configured to protract and retract via a roller or winding system, or similar mechanism 152. In examples, roller or winding system 152 may be configured to couple with back panel 102 and/or frame 101. In examples, roller or winding system 152 may include a housing 154. In examples, roller or winding system may be located at a bottom portion of safe box 100. In examples, a roller or winding system 152 may include a rotating center body able to rotate clockwise and counterclockwise about a central axis. In examples, the center body 153 can be cylindrical. In examples, the center body can be prismatic. In examples, the roller or winding system 152 may be operated manually, by a motor, or any combination thereof. In examples, roller or winding system 152 may operate automatically. In examples, roller or winding system 152 may operate mechanically, hydraulically, electrically, or any combination thereof. In examples, roller or winding system 152 may be controlled by controller 116. In examples, roller or winding system 152 may be controller via a separate control mechanism. In examples, roller or winding system 152 may be controller remotely via a transceiver using wireless communication such as via any wireless means such as for example wi-fi, blue tooth, RF signals, and the like as previously described for other components. In examples, remote control can be done via controller 116, directly, or both.

In examples, as illustrated in FIG. 7H, bottom member 106 can be configured to wind and unwind using a roller system 152. In examples, bottom member 106 may include more flexible sheet material to allow for easier winding. In examples, bottom member 106 may include only flexible sheet material. In examples, bottom member 106 may include foldable panel systems or a series of panels 139 connected by hinges. In examples, bottom member 106 may include alternating rows of flexible sheet and panels. In examples, when using roller system 152, any panel used for bottom member 106 may be sized to allow for winding about rotating center body 153. A roller system 152 or similar mechanism can be installed to support a first end portion of bottom member 106. In examples, a first end of bottom member 106 is connected to a rotating center body 153 of roller system 152. As the center body 153 of roller system 152 rotates bottom member 106 can either retract or protract depending on whether it is being wound or unwound. In examples, in a fully retracted stated, or stowed state, at least a portion of bottom member 106 can be located wound about center body 153. In examples, in the stowed or partially stowed state, at least a portion of bottom 106 is located inside housing 154. In examples, in its fully stowed state at least a portion of bottom member 106 may remain parallel to at least a portion of lid 105 when also in a fully stowed position. In examples, the degree of protrusion and/or retraction of bottom member 106 may be controlled via the roller mechanism 152 by controlling the amount of rotation.

As illustrated in FIGS. 7A-7I, examples may include a lid 105. In examples, lid 105 may be configured to protract and/or retract between a stowed and deployed states. In examples, lid 105 is articulated. In examples, lid 105 is not articulated. In examples, lid 105 is formed of an unbendable panel. In examples, lid 105 is flat when fully protracted, partially protracted, or both. In examples, lid 105 has a curved side profile when fully protracted, partially protracted, or both.

In examples, lid 105 may be transitioned from a stowed state to a deployed state, and back to a stowed state. In examples, during retraction, lid 105 may be configured to fold inward or outward as previously described in conjunction with FIGS. 2A-2E. In examples, lid 105 may be configured to slide or travel along a track, slide, or other like structure. In examples, a track system 143 may be provided along back panel 102 and/or frame 101. Track system 143 may include a track and bearing system, a track and wheel system, slide and pin, a belt system, a hydraulic system, or any other suitable mechanism that can allow for the insertion and extraction of lid 105. In examples, as illustrated in FIG. 7C, track system 143 is parallel to back panel 102 and/or frame 101. In examples, when lid 105 is fully retracted, or partially retracted, i.e. in a stowed or partially deployed state, at least a portion of lid 105 may be parallel to at least a portion of back panel 102 and/or frame 101. In examples, deployment of lid 105 can be caused manually. In examples, deployment of lid 105 may be automatic. In examples, safe box 100 may include a motor operably connected to lid 105 and configured to deploy and/or retract lid 105. In examples, deployment and/or retraction of lid 105 may be controlled by a controller 116, manually, or by remote control.

In examples, when in the stowed state, at least a portion of lid 105 may be configured to lay flat over a top portion of safe box 100. In examples, when in the fully stowed state, at least a portion of lid 105 may be configured to lay horizontal to the bottom portion of safe box 100. In examples, lid 105 is an articulated lid with two or more panels, sections, or slabs pivotally joined. Any pivot joint as previously described can be used, for example, a hinge 109 can provide a pivot joint. In examples, articulated lid 105 includes three pivotally joined panels, sections, or slabs. In examples, the panels, sections, or slabs may be joined in a serial manner. In examples, articulated lid 105 include four pivotally joined panels, sections, or slabs. In examples, articulated lid 105 includes more than four pivotally joined panels, sections, or slabs. For example, articulated lid 105 may include up to five panels, sections, or slabs, six panels, sections, or slabs, ten panels, sections, or slabs, fifteen panels, sections, or slabs, twenty panels, sections, or slabs, thirty panels, sections, or slabs, forty panels, sections, or slabs, fifty panels, sections, or slabs, or a hundred panels, sections, or slabs. In examples, lid 105 is an articulated lid that includes as many pivotally joined panels, sections, or slabs as the number of alternating rows of sheets 136 and panels 137 in bottom member 106. In examples, as illustrated in FIGS. 7C and 7H, lid 105 may be an articulated lid with at least four panels, sections, or slabs 138*a*, 138*b*, 138*c*, and 138*d*. As illustrated in FIG. 7C, in examples, panel, section, or slab, 138*a* may be pivotally joined to panel, section, or slab 138*b* via hinge 109*a*, panel, section, or slab 138*b* may be pivotally joined to panel, section, or slab 138*c* via hinge 109*b*, and panel, section, or slab 138*c* may be pivotally joined to panel, section, or slab 138*d* via hinge 109*c*. In examples, panel, section, or slab 138*d* may be connected to back panel 102 and/or frame 101 via a track 143 and hinge 109*d*. The panels, sections, or slabs of lid 105 can be the same as the sections previously discussed with respect to the foldable panel systems.

In examples, one or more panels, sections, or slabs 138 may be removably connected to one or more other panels, sections, or slabs 138, frame 101 and/or back panel 102. In examples, at least panel, section, or slab 138*a* of lid 105 may be removably connected. In examples, having a panel, section, or slab 138 of lid 105 be removably connected may allow for the replacement of that panel, section, or slab in the event it or any components thereon require replacement or servicing.

In examples, each panel, section, or slab of articulated lid 105 may be independently sized. In examples, all panels, sections, or slabs of articulated lid 105 have the same size. In examples, at least one panel, section, or slab of articulated lid 105 has a size that is different from the size of at least one other panel, section, or slab of articulated lid 105. In examples, at least one panel, section, or slab of articulated lid 105 has a size that is the same as the size of at least one other panel, section, or slab of articulated lid 105. In examples, as illustrated in FIG. 7C, a lid 105 may include an articulated lid with four panels, sections, or slabs in which three panels, sections, or slabs, such as panels, sections, or slabs 138*a*, 138*c*, and 138*d*, have the same size, and one panel, sections or slab, such as section 138*b*, has a size different from that of panels, sections, or slabs 138*a*, 138*c*, and 138*d*. In examples, every panel, section, or slab of an articulated lid 105 has the same width as any other panel, section, or slab. In examples, one or more panels, sections, or slabs of an articulated lid 105 varies in size from at least one other panel, section, or slab in terms of length. As for example illustrated in FIGS. 7C and 7D, panels, sections, or slabs 138*a*, 138*b*, 138*c*, and 138*d* of an articulated lid 105 may all have the same lateral width. As also illustrated in FIGS. 7C and 7D, in examples, panels, sections, or slabs 138*a*, 138*c*, and 138*d* of an articulated lid 105 have the same longitudinal length, while panel, section, or slab 138*b* has a longitudinal length that is different from the longitudinal length of panels, sections, or slabs 138*a*, 138*c*, and 138*d*.

The size of each panel, section, or slab of an articulated lid 105 is not particularly limited. In examples, one or more panels, sections, or slabs of an articulated lid 105 may have a lateral width that is not wider than the width of a surface of support 200 to which safe box 100 is secured. In examples, one or more panels, sections, or slabs of an articulated lid 105 may have a lateral width ranging from 10 inches to 90 inches, 10 inches to 80 inches, 10 inches to 70 inches, 10 inches to 60 inches, 10 inches to 50 inches, 10 inches to 40 inches, 10 inches to 30 inches, or 10 inches to 20 inches. In examples, the lateral width of one or more panels, sections, or slabs of an articulated lid 105 may be 20 inches to 40 inches, 25 inches, 30 inches, or 35 inches. The longitudinal length of one or more panels, sections, or slabs of an articulated lid 105 is also not limited. In examples the one or more sections may have a longitudinal length of at least 0.1 inch and not greater and 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 25 inches, 30 inches, 40 inches, or 50 inches. In examples, first panel, section, or slab 138*a*, third panel, section, or slab 138*c*, and fourth panel, section, or slab 138*d* may each have a length of 6 inches, and second panel, section, or slab 138*b* may have a longitudinal length of 12 inches.

Figure 7I:
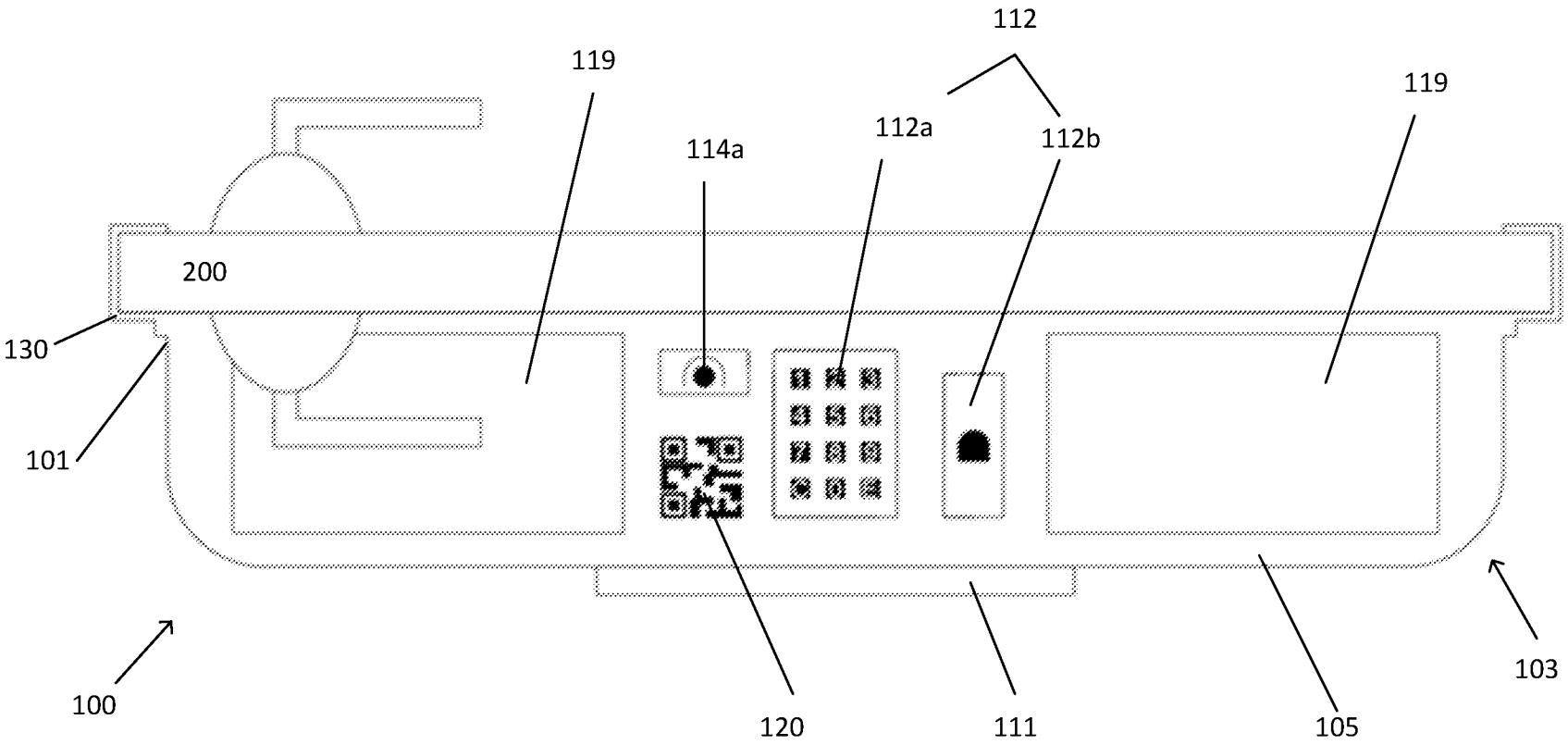

In examples, hinges 109 may be employed to allow closure of lid 105 at varying degrees of deployment. In examples, when in the fully stowed state, panel, section, or slab 138*a* of articulated lid 105 can be pivoted down to rest so that its top surface that faces outward from safe box 100 is horizontal to a bottom portion of safe box 100 as for example shown in FIGS. 7A and 7I. FIG. 7A illustrates a top down view of an example of a safe box 100 that has been fully expanded except for lid 105. FIG. 7I illustrates a top down view of an example of a safe box 100 fully collapsed or fully in a stowed state. As illustrated in FIG. 7I, in examples, rim 146 may fit under panel, section, or slab 138*a* when safe box is fully collapsed. In examples, front panel 103 may abut against an outer edge of lid 105 when lid 105 is engaged to front panel 103 by way of a locking system as described earlier. In examples, as illustrated in FIG. 7I, at least when safe box 100 is fully collapsed, front panel 103 may also slide under an edge of lid 105. In examples, when lid 105 is engaged to front panel 103 the front surface of front panel 103 may be flush with at least a portion of a front edge of lid 105.

In examples, it may be desirable and/or necessary to fully deploy safe box 100 to fit an item or package. In examples, safe box 100 may be partially deployed. In examples, when safe box 100 is partially deployed, lid 105 may be protracted only an amount necessary to secure the contents of the safe box. In examples, an internal volume of safe box 100 can be increased or decreased based on the degree of deployment of the safe box 100. In examples, full deployment of safe box 100 will have all components such as lid 105, bottom member 106, and one or more side members 104 fully protracted or extended. In full deployment, the safe box 100 will have a maximum internal volume based on the size lid 105, bottom member 106, and one or more side members 104. In examples, fully collapse of safe box 100 in a stowed state may provide a minimal internal volume. In examples, a fully collapsed safe box 100 may have no internal space to hold an item. In examples, partial deployment of safe box 100 may have an internal volume that is less than its maximum volume in the fully deployed state and greater than the minimum volume in a fully collapsed state.

In examples, varying degrees of deployment of safe box 100 may be correlated to the configuration of lid 105. For example, the amount of protraction adjustments allowed by a lid 105 when engaging front panel 103 may be directly related to the degree of deployment of safe box 100.

In examples, using the one or more pivot point or hinges 109, on or more panels, sections, or slabs of an articulated lid 105 may be rotated or pivoted to couple lid 105 with the front panel 103. In examples, the varying degrees of deployment of safe box 100 may correspond to the length of panels, sections, or slabs of an articulated lid 105. In examples, where panels, sections, or slabs 138*a*, 138*c*, and 138*d* may each have a length of 6 inches, and panel, section, or slab 138*b* may have a length of 12 inches, the lid 105 may protrude from a portion of support 200 about 6 inches when the safe box 100 is fully collapsed, about 18 inches from a portion of support 200, when the safe box 100 is in a first partially deployed state, about 24 inches from a portion of support 200, when the safe box 100 is in a second partially deployed state, and about 30 inches from a portion of support 200 when the safe box 100 is fully deployed. In examples, the bottom member 106 of safe box 100 may extend by the same amount as lid 105. Thus, for example, bottom member in its retracted state may not protrude more than about six inches from a portion of support 200, no more than about 18 or 24 inches from a portion of support 200 when the safe box 100 is partially deployed, and no more than about thirty inches from a portion of support 200 when the safe box 100 is fully deployed.

In examples, lid 105 may be configured to couple with at least a portion of front panel 103. In examples, the coupling between lid 105 and front panel 103 may be by way of a lock 112, locking mechanism 135*a*/135*b*, or both. In examples, locking mechanism 135*a* may be located on a surface of lid 105 that faces locking mechanism 135*b* when engaging front panel 103. In examples, locking mechanism 135*a* on lid 105 is designed to engage with locking mechanism 135*b* on front portal 103. In examples, locking mechanism 135*a*/135*b* may be part of lock 112. In examples, lock 112 may be separate structure from corollary locking mechanism 135*a*/135*b*.

In examples, as illustrated in FIG. 7D, lid 105 may be configured to engage one or more side members 104. Engagement of one or more side members 104 in addition to or in place of front panel 103 may provide improved closure of safe box 100. Any suitable means may be used to engage lid 105 with one or more side members 104. In examples, lid 105 engages one or more side members 104 to prevent access to the internal volume of the safe box 100. In examples, one or more locks 112 and locking mechanisms 135*a*/135*b* may be implemented to engage lid 105 with one or more side members 104 in a similar manner as discussed with respect to front portion 103. In examples, as illustrated in FIG. 7D, lid 105 may include a track, indentation, channel such as a U-channel, spacing, fitting or any like structure 144 configured to engage with at least a portion of one or more side members 104. In examples, lid 105 may include channel or track 144 on a surface of lid 105 that faces at least a portion of one or more side members 104 when the surface of lid 105 is horizontal to a bottom portion of safe box 100. In examples, the channel or track 144 may be wide enough to fit a thickness of one or more side members 104. As illustrated, in examples, the track or channel 144 may extend the length of one or more side members 104. In examples, the lateral width of lid 105 is wider than a space between two or more side members 104. In examples, as illustrated, the track or U-channel 144 may be offset from a side edge of lid 105 and configured to align with a top portion of one or more side members 104. In examples, as lid 105 is pivoted downward to close a deployed safe box 100, the track or channel 144 is configured to receive a portion one or more side members 104. In examples, the portion of one or more side members 104 received in track or channel 144 may be a thickness of the one or more side members 104.

As also illustrated in FIG. 7D, in examples, lid 105 may include a track, indentation, channel such as a U-channel, spacing, fitting or any like structure 144*a*, similar to channel or track 144 as described above, but configured to engage with at least a top edge portion of front panel 103. In examples, lid 105 may include channel or track 144*a* on a surface of lid 105 that faces at least a portion of front panel 103 when the surface of lid 105 is horizontal to a bottom portion of safe box 100. In examples, the channel or track 144*a* may be wide enough to fit a thickness of the panel of front panel 103. In examples, as illustrated, channel or track 144*a* may extend to include round edges so as to accommodate end portions 129*a* and 129*b* of front panel 103. In examples, a top edge portion of front panel 103 may refer to a portion extending from the top edge of front panel 103 down to a distance that is greater than 0.01 inches, and less than 0.1 inches, 0.3 inches, 0.5 inches, or 1 inch.

In examples, as previously discussed, safe box 100 may include one or more electronic components. In examples, safe box 100 may include one or more cameras, solar panels, sterilizer, keypads, scanners, symbology readers, locks, controller, sensors, alarm, GPS, or any other component previously discussed and/or any combination thereof. In examples, one or more of these components may be located anywhere in safe box 100 that does not interfere with their function. In examples, one or more of these electronic components may be located on lid 105. In examples, one or more components may be located inside lid 105 and/or on either surface of lid 105. In examples, the components are located on a top or outside facing surface of lid 105, on a bottom or inside facing surface of lid 105, or both. In examples, the one or more components may be located anywhere along lid 105. In examples, as illustrated in FIGS. 7A, 7D, and 7I, one or more components may be located on at least one panel, section, or slab of an articulated lid 105. In examples, one or more components may be located on a surface of a panel, section, or slab of an articulated lid 105 that remains accessible when the safe box 100 is fully collapsed, partially collapsed, fully expanded, and/or partially expanded. In examples, as illustrated in FIGS. 7A-7I, lid 105 may include one or more solar panels 119, a lock 112 that may include a keypad 112*a* and/or a scanner such as a finger print reader, iris reader, voice recognition or like device 112*b*, a sterilizer 113, one or more cameras 114*a* and 114*b*, a controller 116 as previously described, one or more sensors 117 as also previously described, a symbology reader 120 such as a UPC code scanner, QR codes reader or other like device, an alarm 121 as previously discussed, a GPS 122 as previously discussed, any combination thereof Any of these and other components may be arranged on lid 105 as illustrated, or anywhere in safe box 100 as previously described. Additional components or multiple iterations of the listed components may also be provided. In examples, one or more of the above mentions electronic components or devices may be located on a removably attached end portion of lid 105, such as for example panel, section, or slab 138*a* as illustrated. Having the components in a removably connected panel, section, or slab may allow for easier replacement and servicing of the components if necessary.

In examples, as illustrated in FIGS. 7A, 7D, and 7I, a camera 114*a* may be provided on an outward facing surface of lid 105 and a camera 114*b* may be provide on an inward facing surface of lid 105 when engaging front panel 103 and/or one or more side members 104. In examples, any camera or other visual capture device may be used for cameras 114*a* and 114*b*. In examples, the cameras can include a charge-couple device (CCD), a CMOS sensor or any like device. In examples, one or both cameras 114*a* and 114*b* include infrared cameras.

As discussed earlier the one or more electronic components discussed herein may be powered by a power source 115. In examples, power source 115 may include a battery. In examples, power source 115 may include a rechargeable battery. In examples, one or more solar panels 119 may be electrically coupled to power source 115 and configured to charge power source 115. In examples, power source 115 may be located anywhere on safe box 100. In examples, power source 115 may be separate from safe box 100. In examples, as illustrated in FIGS. 7C and 7D, power source 115 may be located on front panel 103. In examples, as illustrated, power source 115 may be located at a bottom portion of rim 146.

Figure 8A:
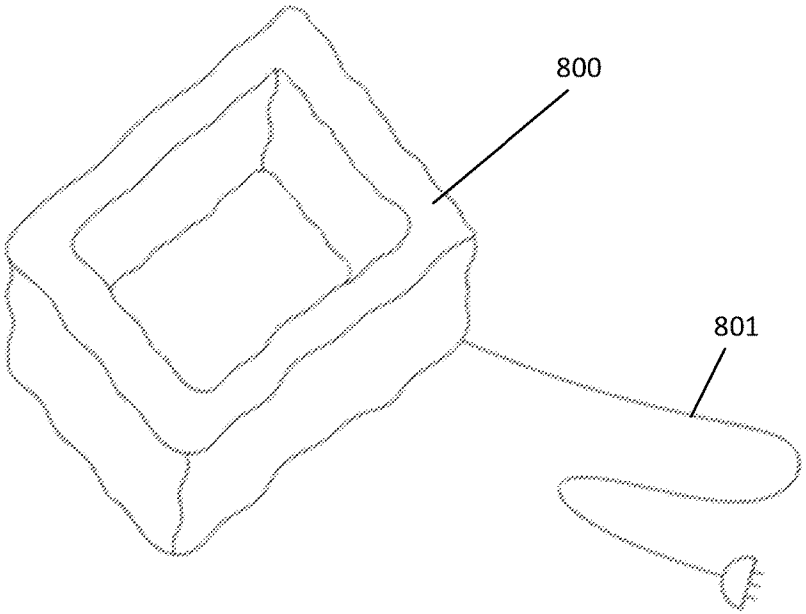
FIGS. 8A and 8B illustrate examples inserts for a safe box as described herein.
Figure 8B:
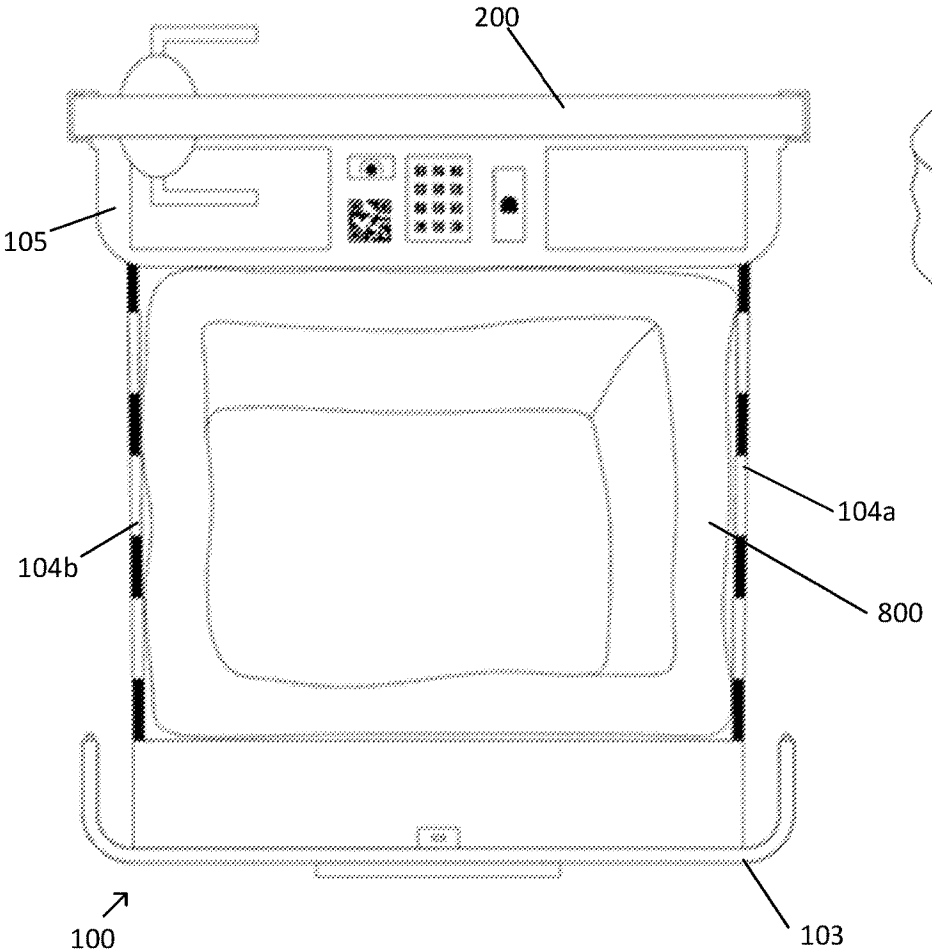

In examples, safe box 100 may include one or more accessories. In examples, as illustrated in FIGS. 8A and 8B, safe box 100 may include a thermal insert 800 such as a thermal blanket. Thermal insert 800 may be a cooling insert, a heating insert, or both. In examples, thermal insert 800 can be configured to be placed inside safe box 100 to affect the temperature inside safe box 100. Thermal insert 800 may be operated electrically. In examples, thermal insert 800 may include its own power source. In examples, thermal insert 800 may include a plug 801 configured to engage a power source. In examples, plug 801 may be configured to engage power source 115.

Figure 9A:
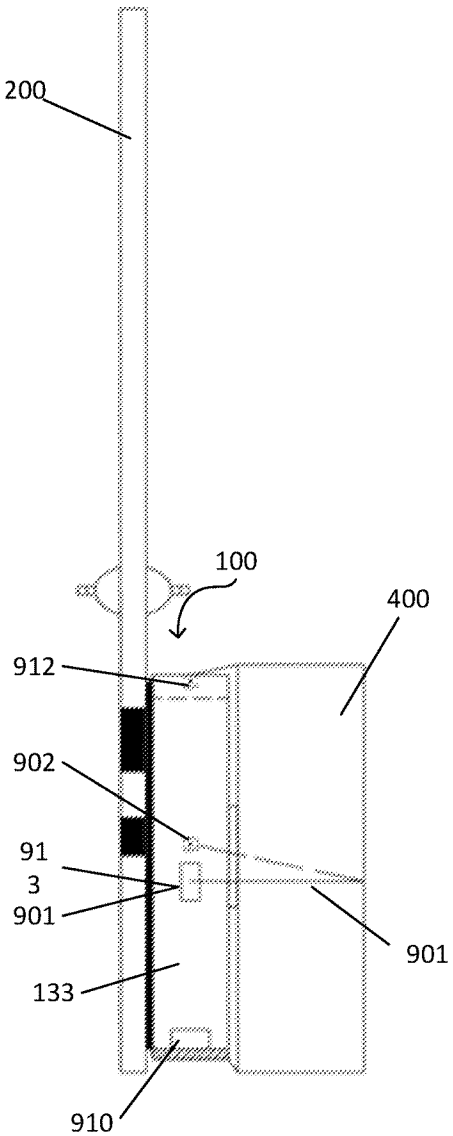
FIGS. 9A and 9B illustrated examples of a security strap or cable for securing an item outside of a safe box as described.
Figure 9B:
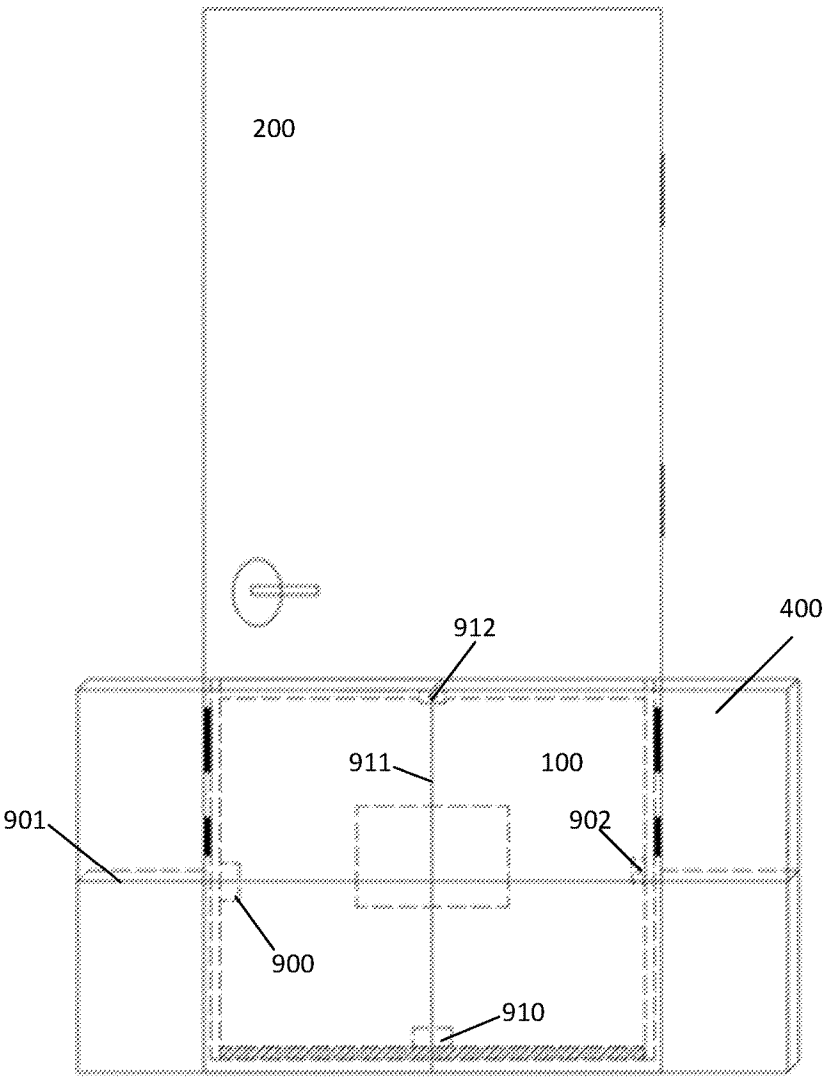

In examples, safe box 100 may also include one or more security straps or cables to secure an item or package to an outside portion of safe box 100. In examples, as illustrated in FIGS. 9A and 9B, a safe box 100 may include at least a strap or cable configured to extend from a first outer portion of safe box 100 to a second outer portion of safe box 100. In examples, one or more straps or cables may be configured to wrap around an item, package, parcel and secure the item, package, or parcel to an outer surface of safe box 100. In examples, one or more straps or cables may be used to secure an item, package, or parcel that cannot fit inside safe box 100 either because of its size, and/or because safe box 100 is full. In examples, the number of straps or cables is not limited.

In examples, the straps or cables can include a flexible material. In examples, the straps or cables can include a material that is difficult to cut, stretch, or otherwise tempered. In examples, the straps or cables can include a material such as natural fiber, polymer, metal, ceramic or any like material, or any combination thereof. In examples, the straps or cables can include a contiguous, cable like form. In examples, the straps or cables can include a series of links, such as chain links. In examples, the straps or cables can include a mixture of cable and links. In examples, the straps or cables may include polymer including nylon, or polyethylene such as, for example, ultra-high molecular weight polyethylene, metals including steel, steel alloys, tungsten, tungsten-steel, carbon, carbon alloy, carbon-steel, metal wire rope, inked hardened steel chain, braided stainless steel cable optionally combined with high tech steel alloys such as in a woven design, or any combination thereof. In examples, the cable or strap may include an outer protective coating such as a plastic and/or polymer coating, for example polyvinyl chloride. Other coating materials may also be used. The length and thickness of a strap or cable is not particularly limited and can be selected based on overall size of safe box 100, level of security desired, size of items intended to secure, and like considerations.

In examples, safe box 100 may include one or more reels to coil and release a strap or cable. In examples, safe box 100 may include one or more engaging or locking means to engage a distal end of the cable or strap to secure it to safe box 100. In examples, the reels or coil may include one or more springs or spring like mechanisms to recoil a strap or cable. In examples, the reels or coil may include a locking mechanism that prevents extension of the strap or cable after it has been secured to the engaging or locking means.

In examples, as illustrated in FIGS. 9A and 9B, a safe box 100 may include a first reel or like mechanism 900. In examples, reel 900 may be affixed to frame 101 and/or back panel 102, or front panel 103. In the illustration, reel 900 may be connected to a side of frame 101 and/or back panel 102. This is just an illustration. In examples, reel 900 may be connected to border 133 of frame 101 and/or back panel 102. In examples, reel 900 may be located on an inner portion of safe box 100. In examples, a strap or cable 901 is wound by reel 900. In examples, frame 101 and/or back panel 102, and/or border 133, may include an opening 913 to allow strap or cable 901 to exit safe box 100. In examples, safe box 100 may include an engaging or locking means 902. Engaging or locking means 902 may include any suitable locking devices to securely engage strap or cable 901. Engaging or locking means 902 may include male-female bearings, push-to-engage locks, hooks, constricting fittings or any like device. In examples, engaging or locking means 902 may include a fitting that after insertion of an end portion of strap or cable 901 is configured to constrict and secure the at least inserted portion of strap or cable 901. In examples, an end portion of strap or cable 901 may include a wider diameter than the rest of the body of strap or cable 901. The locking and release of strap or cable 901 by engaging or locking means 902 may be performed manually, automatically, electronically, or by remote control. In examples, the locking means 902 may be activated using a key, by controller 116, via a remote control or remote user device, using a keypad or scanner provided on safe box 100, or any like structure or combination thereof as for example previously described with respect to lock 112.

Although not specifically illustrated, in examples, reel and engaging means may also be located on front panel 103, or a combination of frame 101 and/or back panel 102 and front panel 103. The functionality would be the same, only the placement would change. In examples, one or more of the reel and securing mechanism may be on a surface of front panel 103 that faces frame 101 and/or back panel 102. In examples, one or more of the reel and securing mechanism may be on rim 146 of front panel 103. In examples, one of the reel or securing mechanism may be on a surface of front panel 103 that faces frame 101 and/or back panel 102 and the other of the reel or securing mechanism may be on rim 146 of front panel 103.

In examples, as illustrated in FIGS. 9A and 9B, safe box 100 may include a second reel or like mechanism 910 similar to reel 900. In examples, a second strap or cable 911 may be wound by second reel 910. Second strap or cable 911 may be the same type or different type as stripe or cable 901. In examples, safe box 100 may include a second engaging or securing means 912 similar as engaging or securing means 902. In examples, as illustrated, an engaging or securing means may be located on frame 101 and/or back panel 102 between lid 105 and support 200. In examples, the first reel 900, first engaging or securing means 902, second reel 910, and second engaging or securing means 912 may be arranged so that when straps or cables 901 and 911 are deployed and lock they cross each other perpendicularly. Other arrangements may also be employed. Also, the number of reels, strap and cables, and engaging and securing means can be varied. In examples, the same engaging and securing means may also be used to secure two or more straps or cables. As illustrated in FIGS. 9A and 9B, an item 400 may be strapped to an outer surface of safe box 100 using security straps or cables as discussed herein by extending one or more security straps or cables from one or more reals, wrapping the securing straps or cables about item 400, and engaging the one or more security straps or reels with one or more engaging or securing means as described above.

Figure 10A:
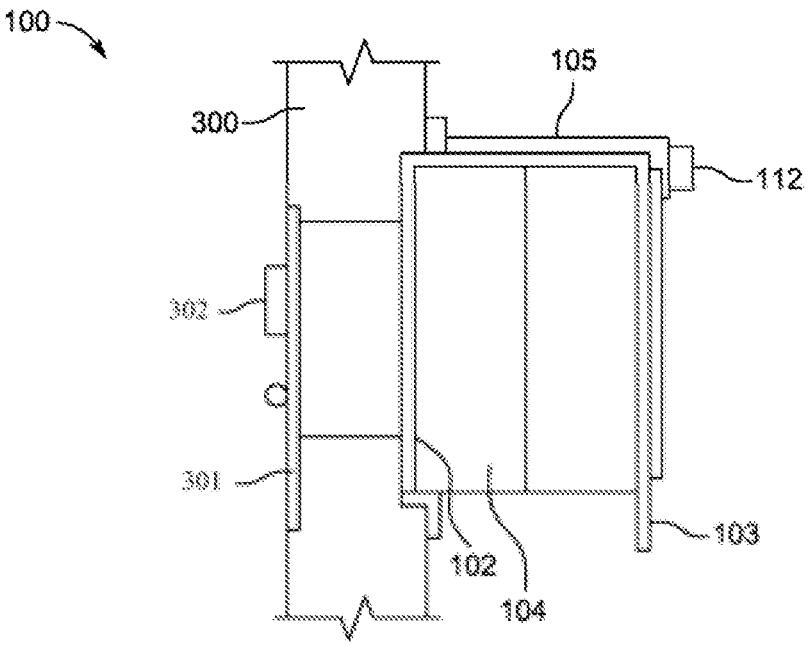
FIGS. 10A and 10B illustrate an example of a permanently fixed safe box.
Figure 10B:
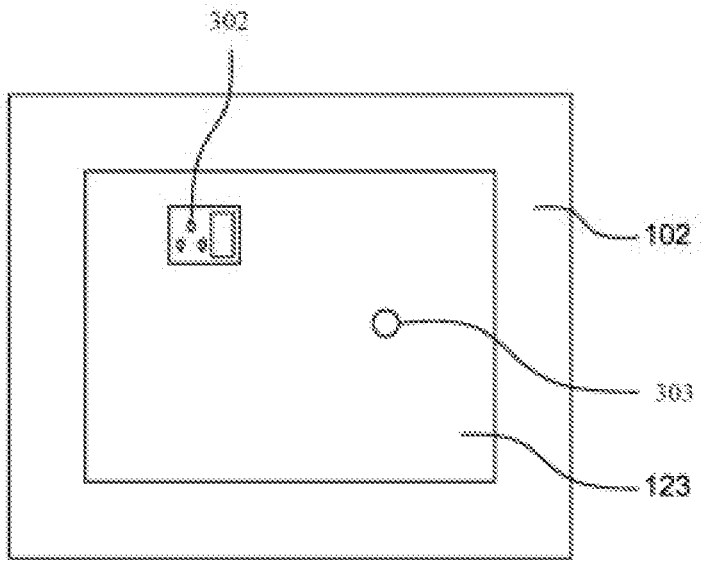

In examples, as for example illustrated in FIGS. 10A and 10B, the collapsible safe box can be securely and permanently affixed to a support 300. For example, the collapsible safe box can be permanently installed on a wall, or other structure. For examples, safe box can be installed to be at least partially located through a wall structure 300. Permanent installation can be accomplished using any known fastener such as by bolts, screws, fittings, and like device. All the features described earlier are equally applicable to this example other than for the fact that it is permanently fixed to a support.

In a permanent fixture example, the back panel 102 of the safe box can include an opening that can be accessible using an access door 301. The access door can be locked by a lock 302 similarly to lock 112 described earlier for the lid or top panel above. The access door may also include a handle 303.

In examples, the collapsible safe box can be used for the delivery of an item or package. In examples, the collapsible safe box can be removably installed on a door panel or gate. Alternatively, the collapsible safe box can be permanently affixed to a fixture like a wall. The safe box can be kept in its collapsed state wherein the front panel and back panel are connected through one or more fasteners. In this state the one or more side members, lid, and bottom member are in a retracted and/or stowed state. In this manner the safe box takes little space. As described, the front panel can include a cover to display an image or message or just as an ornament to better camouflage the safe box with its surrounding environment. For example, the ornamental cover can mimic the door design or wall design upon which the safe box is connected. The cover can have a built-in active screen such as an LED screen. The screen can be used to display information. For example, the screen can be used to display the address. This may assist the delivery company find the user's address at night. The screen can also provide other information that a user may want to communicate.

When a packaged is delivered, the front panel can be disengaged from the back panel and pulled out. The disengagement can be actuated by a touch button release or other means as previously described. In examples, a touch button release can be configured so that the front and back panel release and the safe box can be opened to a deployed state. The deployed state can be a fully extended safe box, or a partially extended safe box. In examples, the safe box can be configured to open on its own once released without requiring it to be manually opened. As this occurs the one or more side members, bottom member and lid of the safe box protract partially or fully. An item or package can then be placed inside the safe box. The lid can then be closed and locked by engaging the lid with the front panel and/or one or more side members. In this manner the item or package can remain safely secured inside the safe box. When the recipient arrives, the lid can be unlocked and the package or item inside can be retrieved. Alternatively, if an access door is provided to the back panel, the package can be retrieved through the access door.

In examples, a camera can be used to monitor any activity surrounding the safe box. This can provide any information about delivery, or any attempt tempering with the safe box.

One or more sensors can detect the proper closure of the safe box. The sensors can signal to a processor that can then either engage the alarm system, sterilizer, stay in stand-by secure mode, or a combination thereof.

In examples, the safe box can also be used to ship items or packages. In such a scenario, the user can place an item or package in the secure box and inform the delivery company that the item or package is ready for pick up. The delivery person can then access the package by unlocking the safe box for example by using a code provided to them by the user.

After removal of the item or package from the safe box, after delivery or pickup, the safe box can be retracted and collapsed back into place. The safe box may be configured to retract automatically or may retract by pushing the front panel toward the back panel until the fasteners lock the two in place. In this manner, the safe box does not occupy unnecessary space.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A collapsible safe box comprising:
a front panel;
a first side member that is protractible and retractable;
a second side member that is protractible and retractable;
a lid that is protractible and retractable;
a bottom member that is protractible and retractable;
a frame configured to removably engage with a structure; and
a telescoping arm operably connected to at least one of the first and the second side members,
wherein the first and second side members each comprise alternating rows of panels and sheets.

2. The collapsible safe box of claim 1, wherein the bottom member comprises alternating rows of panels and sheets.

3. The collapsible safe box of claim 1, further comprising a track along which at least one of the first and the second protractible and retractable side members travel when protracting or retracting.

4. The collapsible safe box of claim 1, wherein the bottom member comprises a flexible material.

5. The collapsible safe box of claim 1, further comprising a roller configured to wind and unwind the bottom member.

6. The collapsible safe box of claim 1, further comprising a telescoping arm operably connected to the bottom member.

7. The collapsible safe box of claim 1, wherein the frame comprises an expandable structure configured to securely clamp onto the structure.

8. The collapsible safe box of claim 1, wherein the front panel further comprises a display screen.

9. The collapsible safe box of claim 1, wherein the lid further comprises a smart lock.

10. The collapsible safe box of claim 1, further comprising one or more hinges configured to connect the lid to a back panel or to the frame.

11. The collapsible safe box of claim 10, wherein a first hinge is configured to connect at least one of the first and the second side members to the back panel or to the frame, and a second hinge is configured to connect at least one of the first and the second side members to the front panel.

12. The collapsible safe box of claim 1, wherein the lid comprises an articulated lid.

13. The collapsible safe box of claim 1, wherein the lid when engaged to the front panel is configured to have a first portion that overlaps at least a front surface of the front panel and a second portion that remains horizontal to the bottom member of the safe box.

14. A collapsible safe box comprising:
a front panel;
a first side member that is protractible and retractable;
a second side member that is protractible and retractable;
a lid that is protractible and retractable;
a bottom member that is protractible and retractable;
a frame configured to removably engage with a structure; and
one or more hinges configured to connect the lid to a back panel or to the frame,
wherein the first and second side members each comprise alternating rows of panels and sheets.

15. The collapsible safe box of claim 14, further comprising a telescoping arm operably connected to at least one of the first and the second side members.

16. The collapsible safe box of claim 14, further comprising a track along which at least one of the first and the second protractible and retractable side members travel when protracting or retracting.

17. The collapsible safe box of claim 14, further comprising a roller configured to wind and unwind the bottom member.

18. The collapsible safe box of claim 14, further comprising a telescoping arm operably connected to the bottom member.

19. A collapsible safe box comprising:

a front panel;

a first side member that is protractible and retractable;

a second side member that is protractible and retractable;

a lid that is protractible and retractable;

a bottom member that is protractible and retractable; and a frame configured to removably engage with a structure;

wherein the first and second side members each comprise alternating rows of panels and sheets, wherein the lid when engaged to the front panel is configured to have a first portion that overlaps at least a front surface of the front panel and a second portion that remains horizontal to the bottom member of the safe box.

20. The collapsible safe box of claim 19, further comprising a track along which at least one of the first and the second protractible and retractable side members travel when protracting or retracting.

* * * * *